US007722117B2

(12) United States Patent
Jones

(10) Patent No.: US 7,722,117 B2
(45) **Date of Patent: *May 25, 2010**

(54) BLEACHER SEAT ATTACHMENT BRACKET

(75) Inventor: Troy Jones, Maize, KS (US)

(73) Assignee: Integrated Stadium Seating, Inc., Wichita, KS (US)

( * ) Notice: Subject to any disclaimer, the term of this patent is extended or adjusted under 35 U.S.C. 154(b) by 461 days.

This patent is subject to a terminal disclaimer.

(21) Appl. No.: 11/534,931

(22) Filed: Sep. 25, 2006

(65) Prior Publication Data

US 2007/0018491 A1 Jan. 25, 2007

Related U.S. Application Data

(63) Continuation-in-part of application No. 11/172,171, filed on Jun. 30, 2005, now Pat. No. 7,525,275, which is a continuation-in-part of application No. 11/046,366, filed on Jan. 28, 2005, now abandoned, which is a continuation-in-part of application No. 10/890,818, filed on Jul. 14, 2004, now Pat. No. 7,104,605, which is a continuation-in-part of application No. 10/846,136, filed on May 14, 2004, now Pat. No. 6,926,360, which is a continuation of application No. 10/348,785, filed on Jan. 22, 2003, now Pat. No. 6,739,667.

(51) Int. Cl.
*A47C 1/08* (2006.01)

(52) U.S. Cl. ..... 297/252; 297/230.1; 297/230.11; 297/352

(58) Field of Classification Search ..... 297/19, 297/230.1, 230.11, 230.12, 230.14, 252, 297/352, 188.01, 188.04, 228.11, 228.12, 297/228.13

See application file for complete search history.

(56) References Cited

U.S. PATENT DOCUMENTS

| | | | | |
|---|---|---|---|---|
| 116,934 | A | 7/1871 | Cutter | |
| 1,304,753 | A * | 5/1919 | Dwyer | 297/218.4 |
| 2,059,493 | A | 11/1936 | Schoenhoff | |
| 2,152,014 | A | 3/1939 | Ashe et al. | |
| 2,260,352 | A | 10/1941 | Trapani | |
| 2,306,673 | A | 12/1942 | Tucker | |
| 2,707,513 | A | 5/1955 | Lake | |
| 2,754,891 | A | 7/1956 | Barron | |
| 2,756,808 | A | 7/1956 | Elchorst | |
| 2,792,875 | A | 5/1957 | Pirrone | |
| 2,822,862 | A | 2/1958 | Zacks | |
| 3,062,586 | A | 11/1962 | Rowland | |
| 3,066,980 | A * | 12/1962 | Clute | 297/252 |

(Continued)

OTHER PUBLICATIONS

College Comfort Stadium Chair Back Program brochure; College Comfort LLC; 8 pages.

*Primary Examiner*—Laurie K Cranmer
(74) *Attorney, Agent, or Firm*—Dorsey & Whitney LLP; Jason M. Hunt; Devan V. Padmanabhan

(57) ABSTRACT

A seat cushion for selective attachment to a bleacher seat includes a bracket with a front jaw and a rear jaw. The front jaw includes multiple laterally spaced attachment locations for the rear jaw. A cushioned seat including a cushioned bottom and a flexible connected backrest attaches to the bracket to be held in place on a bleacher. The backrest may include a pocket formed from a transparent material for displaying a card within the pocket.

20 Claims, 23 Drawing Sheets

U.S. PATENT DOCUMENTS 3,220,767 A * 11/1965 Hendrickson ..... 297/228.12
3,278,226 A 10/1966 Vincent Magnusson
3,556,589 A 1/1971 Messier
4,394,783 A 7/1983 Simmons
4,396,227 A 8/1983 Neilson
4,432,525 A * 2/1984 Duvall ..... 248/430
4,597,605 A * 7/1986 Gilbert ..... 297/228.1
4,824,169 A 4/1989 Jarrell
5,297,848 A * 3/1994 Grinnell ..... 297/219.1
5,403,066 A 4/1995 Drum
5,557,815 A * 9/1996 Mintz et al. ..... 5/636
5,857,226 A 1/1999 Sommer
5,868,463 A * 2/1999 MacKenzie et al. .... 297/228.12
6,174,082 B1 * 1/2001 Pelky et al. ..... 383/22
6,175,980 B1 * 1/2001 Gaither ..... 5/654
6,352,306 B1 * 3/2002 Dreiling ..... 297/252
6,502,902 B1 * 1/2003 Romero ..... 297/352
6,588,840 B1 * 7/2003 Lombardo ..... 297/228.12
6,648,410 B2 * 11/2003 Sparks ..... 297/228.12
6,652,026 B2 11/2003 Toyota
6,739,667 B1 5/2004 Jones
6,899,391 B1 * 5/2005 Schneller et al. ..... 297/252
6,905,169 B1 * 6/2005 Donoghue ..... 297/250.1
6,926,360 B2 8/2005 Jones
7,104,605 B2 9/2006 Jones
7,121,621 B1 * 10/2006 Starheim et al. ..... 297/188.04
7,316,452 B2 1/2008 Vestweber
7,374,246 B2 * 5/2008 Jones ..... 297/352
7,575,275 B2 8/2009 Jones
2002/0047294 A1 * 4/2002 Ellinidis et al. ..... 297/188.04
2008/0100114 A1 * 5/2008 Vestweber ..... 297/352

* cited by examiner

FIG. 30
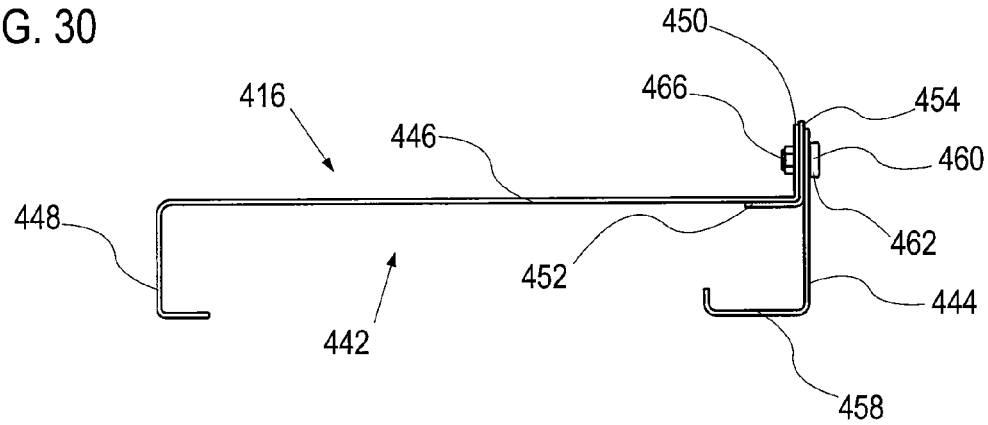
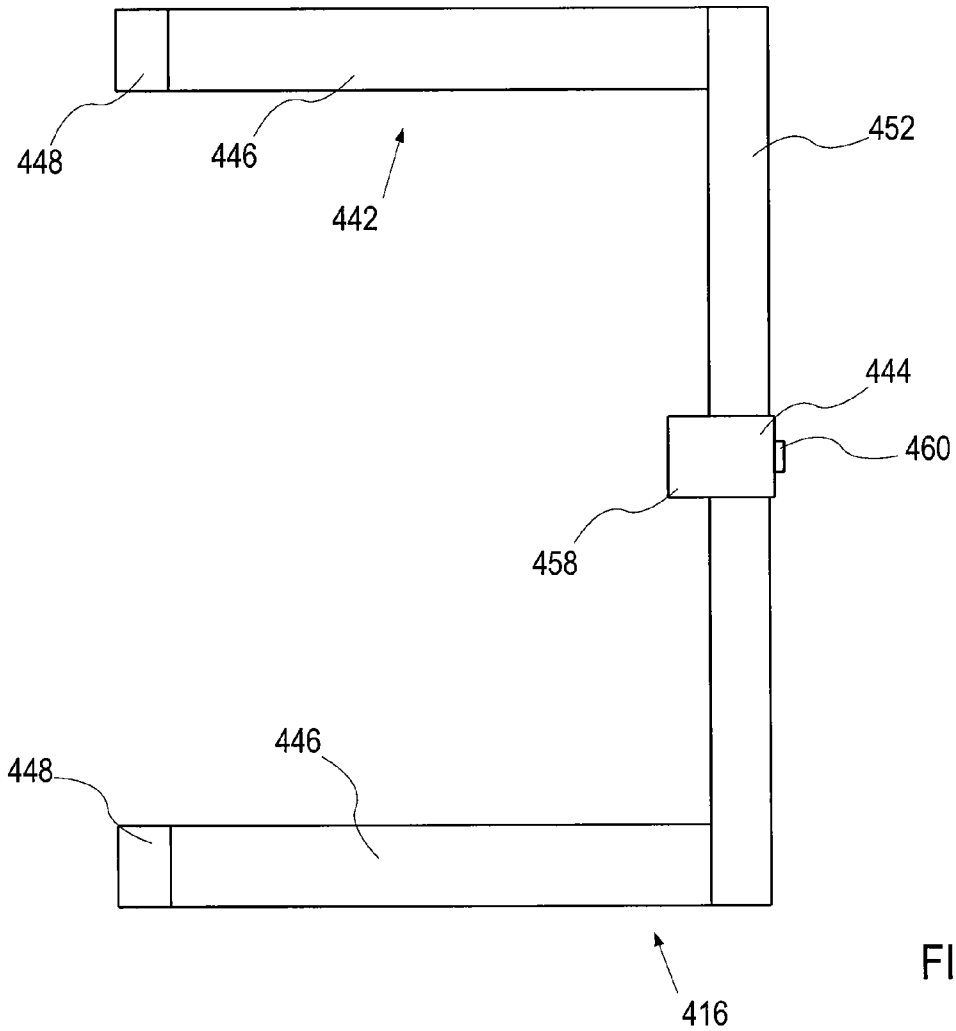
FIG. 31

FIG. 33
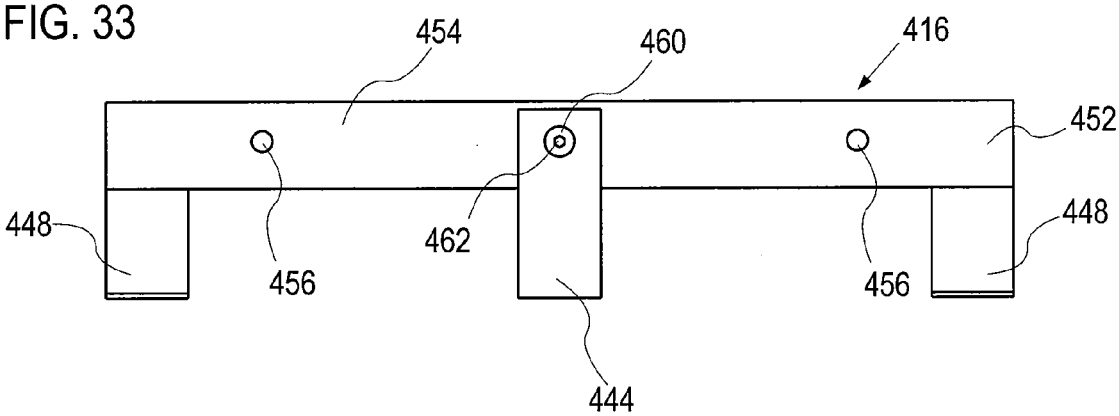
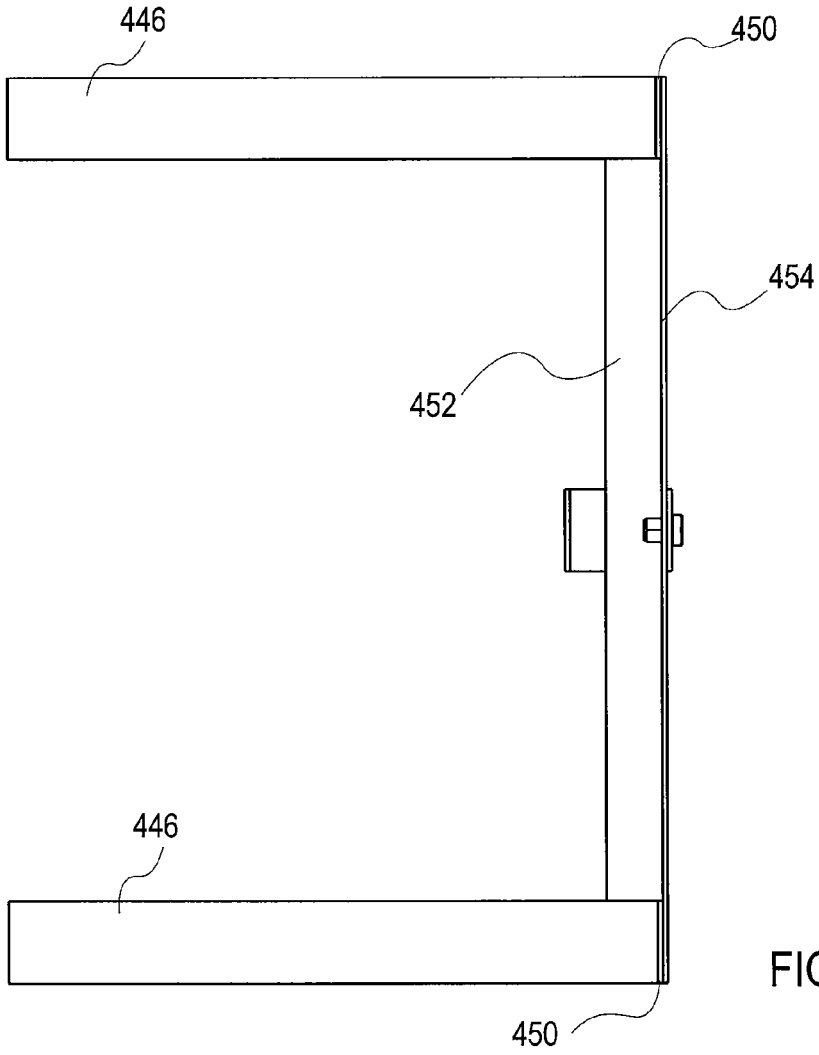
FIG. 32

BLEACHER SEAT ATTACHMENT BRACKET

CROSS-REFERENCE TO RELATED APPLICATIONS

This application is a continuation-in-part of U.S. patent application Ser. No. 11/172,171, filed Jun. 30, 2005, which is a continuation-in-part of U.S. patent application Ser. No. 11/046,366, filed Jan. 28, 2005 and is now abandoned, which is a continuation-in-part of U.S. patent application Ser. No. 10/890,818, filed Jul. 14, 2004, now U.S. Pat. No. 7,104,605, which is a continuation-in-part of U.S. patent application Ser. No. 10/846,136, filed May 14, 2004, now U.S. Pat. No. 6,926, 360, which is a continuation of U.S. patent application Ser. No. 10/348,785, filed on Jan. 22, 2003, now U.S. Pat. No. 6,739,667, the entire contents all of which are hereby incorporated by reference.

FIELD OF THE INVENTION

The present invention relates to seat cushions. More specifically, the present invention relates to cushions that are attachable to or usable with stadium seating, such as bleachers.

BACKGROUND OF THE INVENTION

Bleacher-type seating is often provided for spectator events such as sporting events, concerts, and the like. Such seating is often provided in a permanent setting, such as a stadium, a semi-permanent setting, such as retractable bleachers in a gymnasium, or on a temporary basis for specific events. Bleachers provide simple, efficient and convenient seating for a large number of spectators; however, bleachers do not necessarily provide the most comfortable seating nor do they typically identify an individual seating location.

To improve the comfort of such seating, patrons sometimes bring their own seats or cushions. While an improvement in comfort, such a solution requires the patron to remember to bring their own device, which is often an afterthought and/or a very easily overlooked consideration when attending an otherwise exciting event. In addition, having spectators hauling their own chairs or cushion into a stadium seating arrangement can be inconvenient and possibly even dangerous to other spectators. That is, walkways are narrow and space is extremely limited so carrying extra items (especially if large, bulky or cumbersome) presents a challenge.

Thus, there exists a need to balance the conveniences and mass seating offered through stadium or bleacher seating with a degree of personal comfort.

BRIEF SUMMARY OF THE INVENTION

The present invention, according to one embodiment, is a seat cushion for a removable attachment to a bleacher seat. The seat cushion includes a bottom cushioned portion including a bottom surface for resting on a upwardly facing surface on a bleacher seat. A bracket is provided that includes a front jaw for engaging a front portion of the bleacher seat. The bracket also has a rear jaw for engaging a rear portion of the bleacher seat. A tightening member is provided to draw the front and rear jaws together. The front jaw includes a plurality of attachment openings for receiving the tightening member. The attachment openings are laterally spaced apart such that the tightening member may be selectively connected at a plurality of locations. An attachment element on the bottom surface of the bottom cushioned portion is adapted for attachment to the bracket. The front jaw may include an upwardly turned lip portion to restrain the bottom cushioned portion against rearward movement. The seat cushion may also include a backrest portion flexibly connected to the bottom cushioned portion. Flexible constraints may be used to limit the range of rearward rotation of the back rest relative to the bottom cushioned portion. The flexible constraints may be adjustable length belts. The backrest portion may include a pocket on its back surface. The pocket may be formed from a transparent material.

According to another embodiment, the present invention is a bracket for use in attaching a cushioned seat to a bleacher seat. The bracket includes a front jaw having front portion for engagement with a front portion of a bleacher seat and a rear portion including a plurality of laterally offset passageways. A rear jaw has a rear portion for engagement with a rear portion of the bleacher seat. The rear jaw includes an aperture for alignment with any one of the passageways in the front jaw. An attachment member can bind the front and rear jaws together upon insertion through the aperture and one of the passageways aligned with the aperture.

According to yet another embodiment, the present invention is a method of attaching a cushioned seat to a bleacher seat by providing a cushioned seat having a bottom cushioned portion with a bottom surface, the bottom surface including a plurality of loops. A bracket is provided that includes a front jaw having front portion for engagement with a front portion of a bleacher seat and a rear portion including a plurality of laterally offset passageways. The bracket also includes a rear jaw having a rear portion for engagement with a rear portion of the bleacher seat. The rear jaw includes an aperture for alignment with any one of the passageways in the front jaw. The bracket further includes an attachment member for binding the front and rear jaws together upon insertion through the aperture and one of the passageways aligned with the aperture. The front jaw is attached to the cushioned seat by inserting the front jaw into the loops. The front jaw and cushioned seat are attached to the bleacher seat by aligning the aperture in the rear jaw with a selected one of the passageways in the front jaw and inserting the attachment member through the aperture and the selected passageway.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive. The use of descriptive terms such as up, down, vertical and horizontal are for illustrative purposes only, are not meant to be limiting, and are used by way of example with respect to the illustrations presented.

BRIEF DESCRIPTION OF THE DRAWINGS

FIG. 30 is a side elevation view of an attachment bracket according to one embodiment of the present invention;

FIG. 31 is a bottom plan view of the attachment bracket of FIG. 30;

FIG. 32 is a top plan view of the attachment bracket of FIG. 30;

FIG. 33 is a rear elevation view of the attachment bracket of FIG. 30;

DETAILED DESCRIPTION

The cushions of the present invention, according to one embodiment, can be used is to provide designated, comfortable seating to select patrons in a stadium seating arrangement. For example, the stadium may rent the present stadium cushions to any patron who so chooses. In such a scenario, stadium personnel would most likely secure all of the stadium cushions to the bleachers in the appropriate locations before the arrival of the patrons. This provides many advantages. For example, it can provide a source of advertising, by allowing printed matter to be prominently displayed on the stadium cushions awaiting the arrival of patrons. It also allows a particular space or seating location to be physically identified and/or reserved for a particular patron.

Alternatively, the cushions of the present invention are quickly attachable and detachable from the stadium seating such that a patron could bring the cushion to the stadium, attach it to the patron's seat, and remove the cushion from the stadium when the patron leaves at the end of the event.

Figure 1:
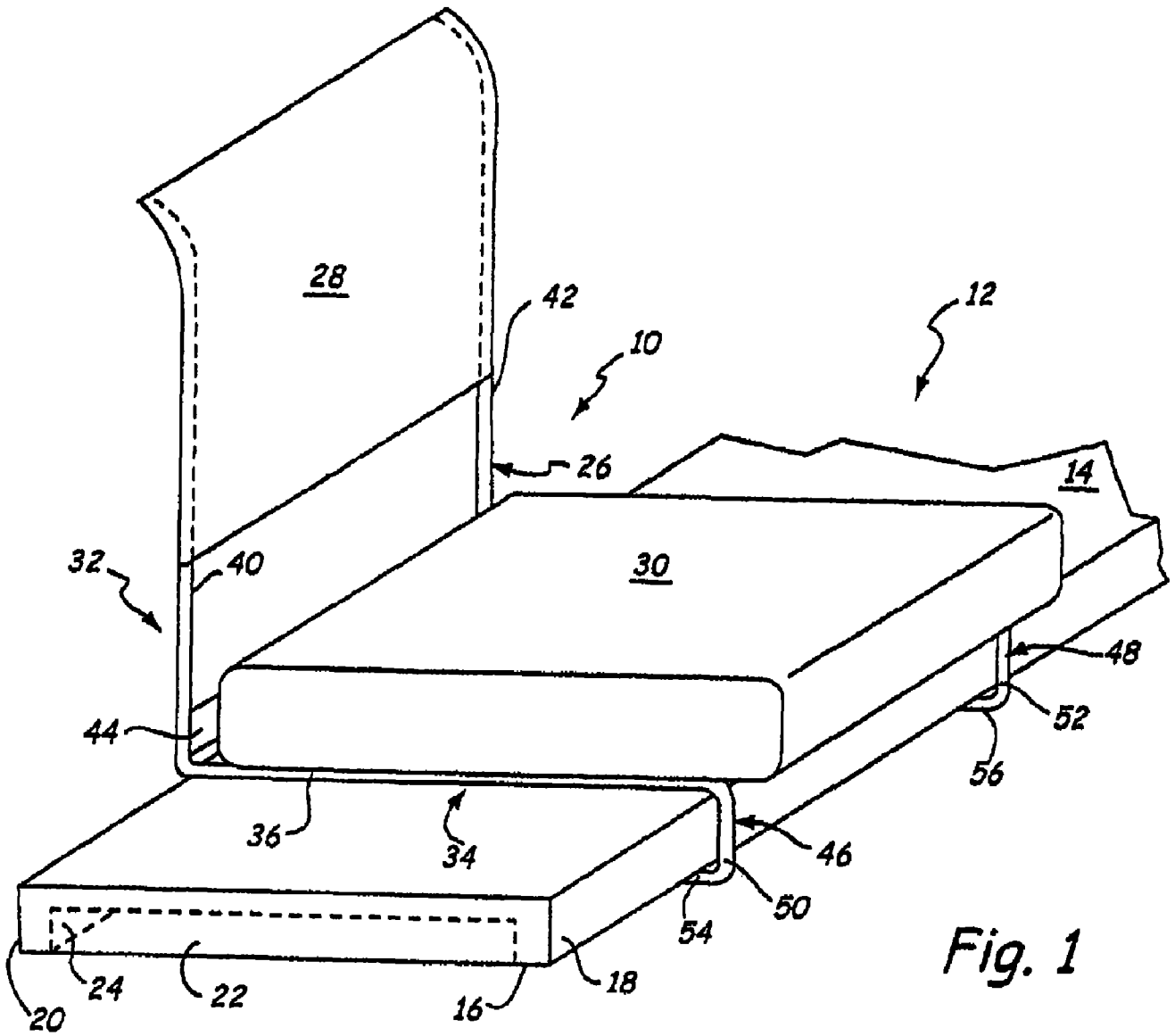
FIG. 1 is an isometric view of a stadium chair attached to a bleacher in accordance with one embodiment of the present invention.

FIG. 1 is an isometric view of a stadium chair 10 attached to a bleacher 12 in accordance with one embodiment of the present invention. The bleacher 12 can take many forms. As illustrated, the bleacher 12 may be an elongated plank-like member having a planar upper seating surface 14, a lower surface 16, a front face 18 and rear face 20. The bleacher 12 may be made from various materials including wood or aluminum. As illustrated in phantom, the bleacher 12 may also include a recess 22 having one or more lips 24 and one or more ribs (not shown) to provide additional structural support.

The stadium chair 10 rests on the upper seating surface 14 and is secured to both the front face 18 and rear face 20 of the bleacher. The particular configuration of the bleacher 12 may affect which particular securement members (described more fully below) should be used.

Figure 2:
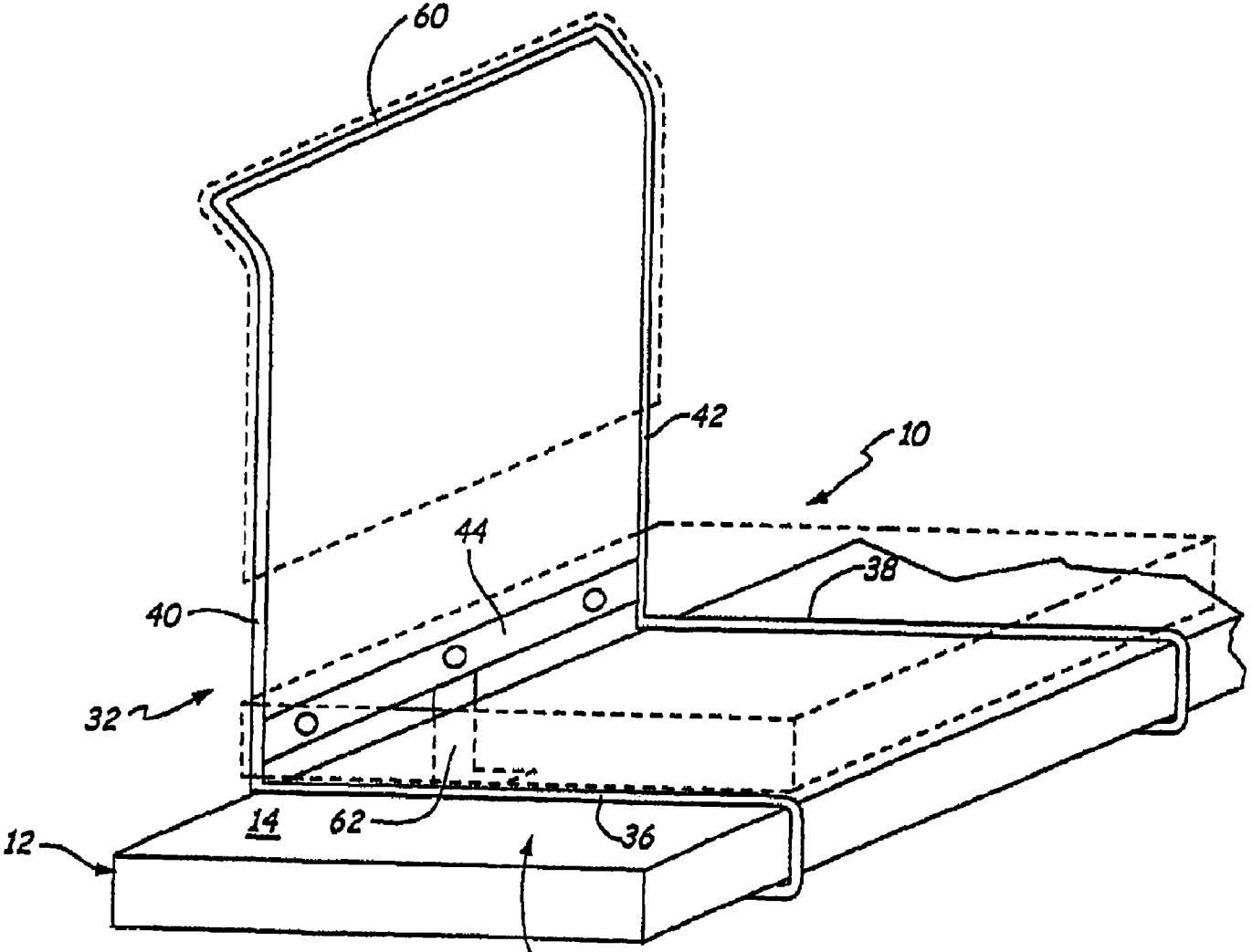
FIG. 2 is a partially sectional view of the stadium chair of FIG. 1.

Referring to FIGS. 1 and 2, the stadium chair 10 includes a frame 26. As illustrated, frame 26 is formed from a tubular or cylindrical member that is appropriately bent at predetermined angles to form the frame structure. The frame 26 could be formed from any suitable material such as metal (e.g., aluminum, steel tubing or steel rod), plastic or the like. The choice of materials will determine whether the frame 26 is formed via bending or as a pre-shaped component (e.g., molded, cast, injection molded). As illustrated, the frame 26 is a single component forming a first generally U-shaped bracket 46 having a first face engaging member 50 and a first lower surface engaging member 54. Likewise, the frame 26 includes at an opposite end a second generally U-shaped bracket 48 having a second face engaging member 52 and a second lower surface engaging member 56.

The frame 26 includes a first horizontal member 36 and a second horizontal member 38 which rest atop the upper seating surface 14 when the stadium chair 10 is positioned as illustrated. The horizontal members 36, 38 define a seat portion 34 of the frame 26. Depending from the horizontal members 36, 38 and extending upwards (as illustrated) is a back portion 32 of the frame 26 that is defined by a first upright member 40 and a second upright member 42. The first and second upright members 40, 42 are optionally interconnected by an upright cross member 60. The upper section of back portion 32 may be angled backwards or away from bleacher 12. This provides a more comfortable seat back for patrons by preventing the upper corners from engaging the back of the patron. In addition, the angled portion aides in securing a backrest 28 to the frame 26. That is, backrest 28 is a flexible member having an interior cavity allowing the backrest 28 to be slipped over the back portion 32. The angle can increase the tension of the backrest 28, making it more secure. In addition, clips (not shown) or other attachment members can be used to temporarily or permanently secure the backrest 28 to the frame 26.

A seat cushion 30 is placed atop the seat portion 34 of frame 26. The seat cushion 30 provides a comfortable seating surface for the patron. The cushion 30 and backrest 28 can be made from any appropriate material such as vinyl, plastic, or the like. If exposed to the environment, the material chosen preferably is suitably durable and/or weather resistant. The cushion 30 and/or the backrest 28 can include a desired amount of padding or cushioning to achieve a desired size, shape and degree of comfort.

In use, the frame 26 is positioned so that the first and second generally U-shaped brackets 46, 48 loop over the front face 18 of the bleacher 12. The shape of the generally U-shaped brackets 46, 48 and the overall rigidity of the frame 26 thus prevent the stadium chair 10 from tipping either forwards or backwards. An attachment bracket 44 is positioned on the back portion 32 of the frame 26, between the first and second uprights 40, 42. The attachment bracket 44 provides additional strength and rigidity to the overall frame assembly. An L-shaped attachment clamp 62 is releasably secured to the attachment bracket 44 and is positioned so that a portion thereof is below the bleacher 12, in contact with lower surface 16, as shown in FIG. 2. Thus, as attachment clamp 62 is tightened against attachment bracket 44, attachment clamp 62 frictionally engages bleacher 12, effectively clamping stadium chair 10 to the bleacher 12. In this manner, stadium chair 10 is prevented from being tilted forwards or backwards; sliding forwards or backwards (e.g., off the bleacher 12), lifted vertically; and if sufficient tension is applied, from sliding horizontally along upper surface 14. Thus, a defined location on the bleacher 12 is presented that provides a comfortable, backed seating position to a patron.

Figure 3:
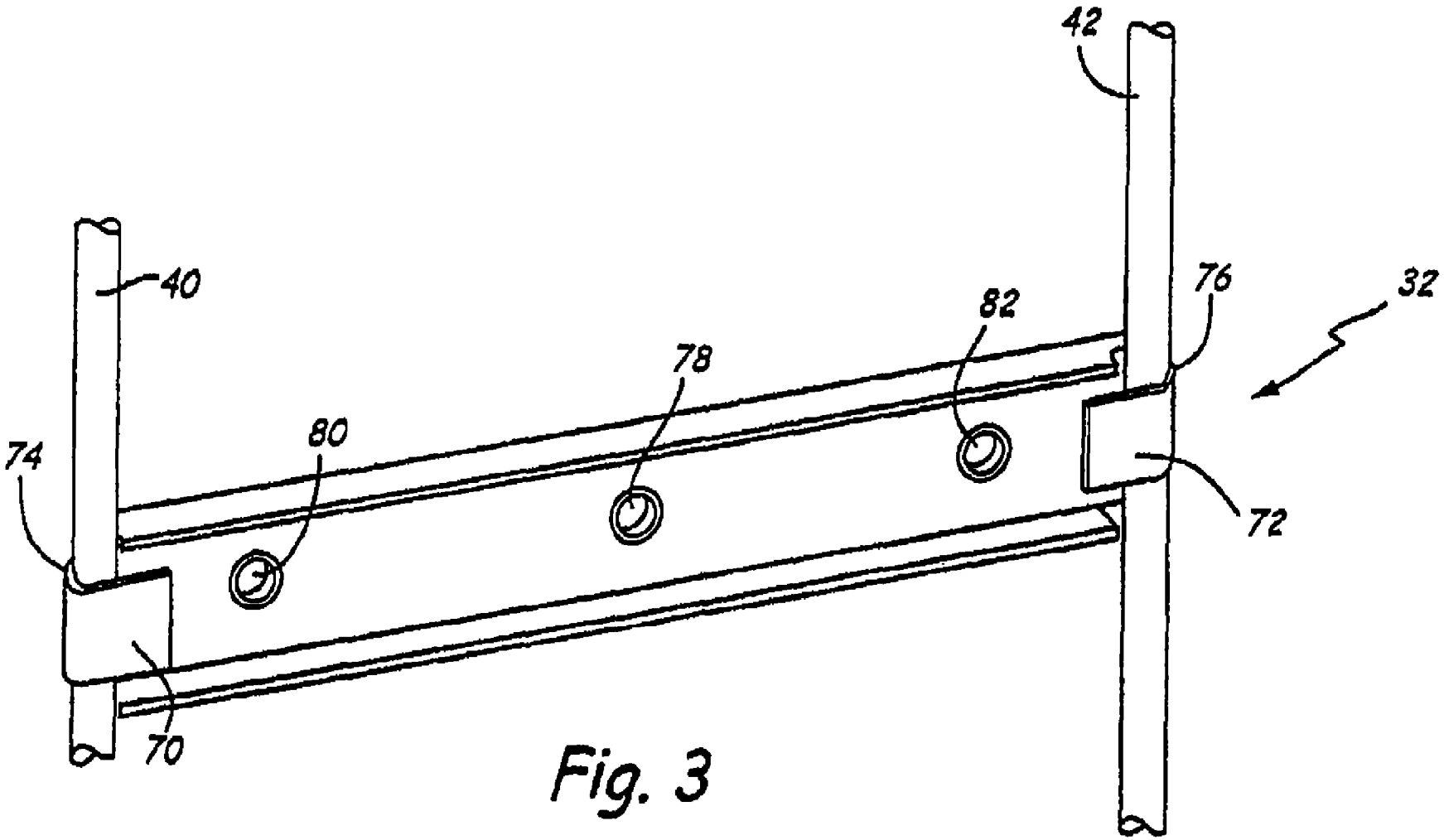
FIG. 3 is an isometric view of a portion of a frame of the stadium chair of FIG. 1 along with an attachment bracket useful in securing the stadium chair to a bleacher.

FIG. 3 is an isometric view of one embodiment of the attachment bracket 44. The attachment bracket 44 is preferably a rigid member made of suitably strong material such as metal. For example, attachment bracket 44 could be stamped, cast, bent or otherwise fabricated from steel, aluminum or the like. Attachment bracket 44 is a channeled member having some degree of depth or thickness. At opposing ends, a first tab 70 and a second tab 72 are provided. The tabs 70, 72 may be bent around upright member 40, 42 respectively to secure the attachment bracket 44 to the frame 26. Other methods of attachment such as bolting, crimping, clamping, welding, or the like may also be used to secure the attachment bracket 44 to the upright members 40, 42 of the frame 26. As the tabs 70, 72 are bent around upright members 40, 42, they form channels 74, 76 that ultimately receive and frictionally engage the upright members 40, 42. Thus, the attachment bracket is securely attached to a given position on the back portion 32 of the frame 26.

The attachment bracket 44 is provided with one or more threaded throughbores 78, 80, 82. If multiple clamps 62 are to be attached they may be balanced by utilizing left and right threaded throughbores 80, 82. If only one clamp 62 is to be used, it may normally be secured to central threaded throughbore 78 or alternatively to any throughbore that is unobstructed. That is, the seat 10 may be positioned as desired and the multiple throughbores 78, 80, 82 provide for multiple attachment points. Thus, if one or more attachment points is obscured or occluded by an obstruction (e.g., a frame member of the bleacher 12), it is a simple matter to utilize one of the other unobstructed attachment points. Fewer threaded throughbores may be provided, more may be provided, and different configurations could also be utilized as desired.

By utilizing an attachment bracket 44, frame 26 can be made as a relatively simple and straightforward component. That is, the frame 26 can be easily and readily produced as can the attachment bracket 44. These two components can be quickly and easily joined to produce a complete frame assembly.

Figure 4:
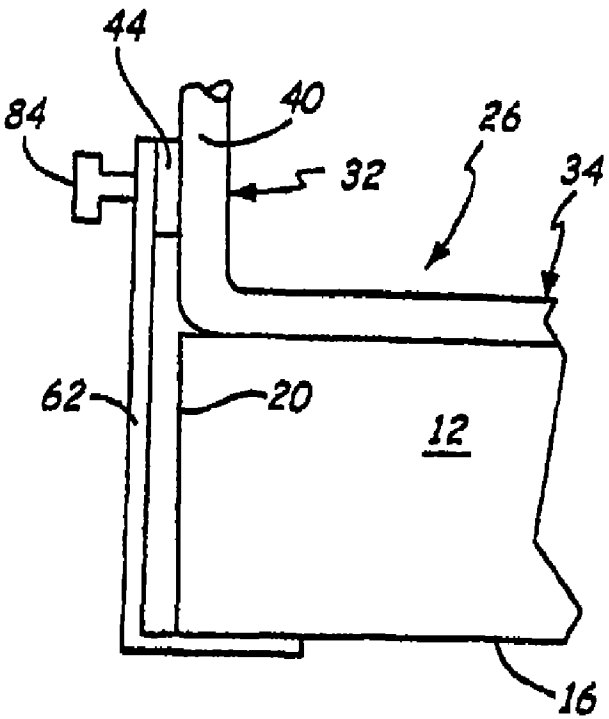
FIG. 4 is a side, planar view illustrating a portion of the stadium chair frame and the attachment to a bleacher with an attachment clamp.

FIG. 4 illustrates how attachment clamp 62 is secured to attachment bracket 44 and how clamp 62 engages bleacher 12. A threaded member such as bolt 84 is passed through an upper portion of clamp 62 so as to engage one of the threaded throughbores 78, 80, 82 illustrated in FIG. 3. Rotating the bolt 84 causes the clamp 62 to abut and engage the attachment bracket 44, in the known way. Thus, by tightening the bolt 84, the clamp 62 is secured; this in turn effectively secures the chair 10 to the bleacher 12. As shown, the clamp 62 is spaced from the rear face 20; however, these two portions could be in contact. Likewise, as illustrated, clamp 62 contacts the lower surface 16; however, a small gap could also be present.

Figure 13:
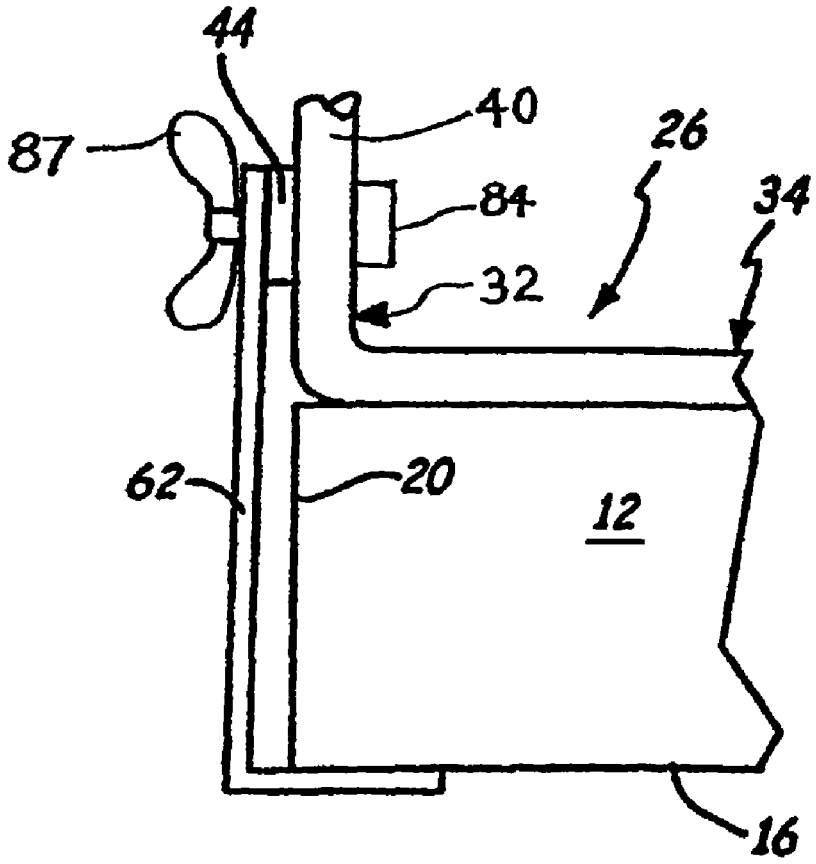
FIG. 13 is a side, planer view illustrating a portion of the stadium chair frame and attachment to a bleacher with an attachment clamp.

In a particularly efficient arrangement, one of the clamps 62 could be loosely attached to each of the chairs 10 prior to installation on the bleachers. Thus, the installer could position the chair 10, pivot the clamp into place, tighten the bolt 84 with a wrench or the like and the chair 10 is installed. When installing hundreds or even thousands of chairs at one time, this efficiency is well placed. Alternatively, various other known attachment mechanisms could be used to secure the clamp 62 to the attachment bracket 44. For example, as shown in FIG. 13, the throughbore 78, 80, 82 need not be threaded. Rather, a threaded member 84 (e.g., a bolt) could be passed therethrough and secured with a fastener 87, such as a nut, wing nut, cotter pin, or the like. This may, in some cases, allow installation and removal without requiring a separate tool. For example, a wing nut could be manually tightened or loosened by hand. In such an example, the bolt head may be positioned underneath the seat cushion 30 so that the wing nut would be exposed from behind the chair 10. Additionally, the clamp 62 could be secured to attachment bracket 44 via any other attachment clamps, levers, connectors or brackets that would allow the clamp 62 to be appropriately tensioned against the attachment bracket 44 with a desired degree of manipulation.

Figure 5:
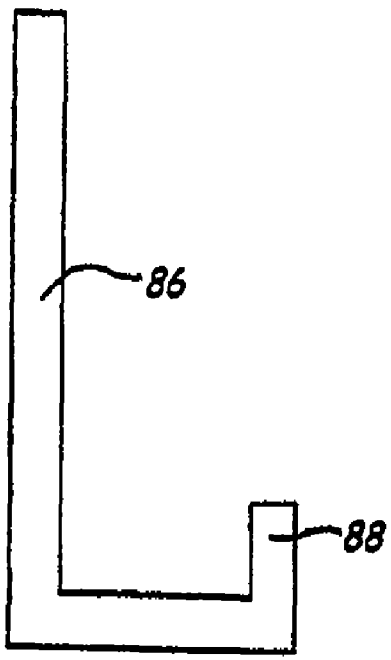
FIG. 5 is side, planar view of an alternative attachment clamp.

As mentioned above, some bleachers 14 may have lips 24 and recesses 22 (FIG. 1). In such a case, a J-clamp 86, as illustrated in FIG. 5, can be utilized. That is, the J-clamp 86 is secured to the attachment bracket 44 instead of the L-shaped attachment clamp 62. The J-clamp 86 includes a lip 88 that is received within recess 22 an may abut lip 24. The J-clamp provides additional security when attaching the seats 10.

With the use of either type of clamp 62, 86 the attachment of the stadium chair 10 to the bleacher 12 is a relatively quick and easy process that results in semi-permanent attachment. That is, the seat cannot be readily removed by a patron (without the aid of a tool such as a wrench). This serves to protect the chairs 10, reduce vandalism, reduce accidental damage, and prevent theft. Also, the chairs (if left over time) need only be positioned once.

Figure 7:
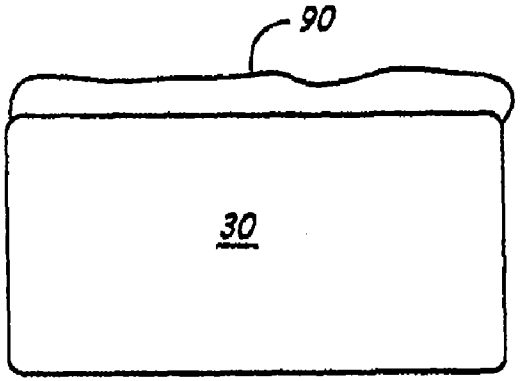
FIG. 7 is a top, planar view of the seat cushion and the securing strap of FIG. 6.
Figure 8:
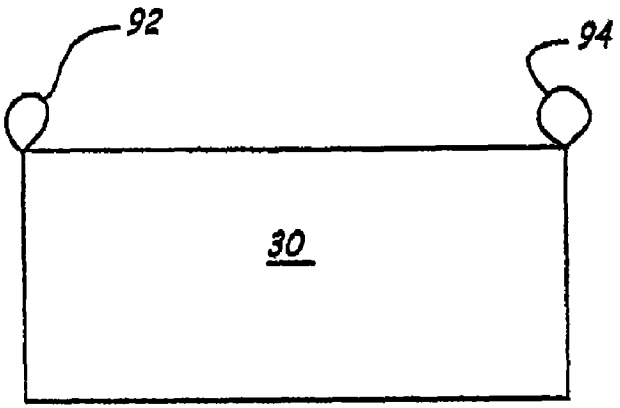
FIG. 8 is a top, planar view of the seat cushion with alternative securement straps for securing the seat cushion to the frame.
Figure 6:
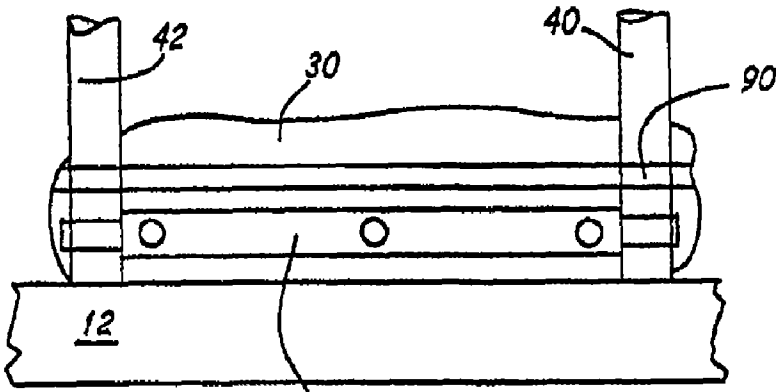
FIG. 6 is a rear, planar view of a securing strap for securing a seat cushion to the frame of the stadium chair.

In furtherance of many of these same goals, it may be desirable to secure the seat cushion 30 to the frame 26. FIGS. 6-7 illustrate having a single securement strap 90 connected to opposite rear corners of the seat cushion 30 that can be looped around the upright members 40, 42. This serves to hold the cushion 30 in the position illustrated and prevent it from being tipped forward. To attach, the cushion 30 is lowered into place while the strap 90 is simply slipped over the upright member 40, 42. Alternatively, the strap 90 could be openable or removable (e.g., hook and loop type fasteners. FIG. 8 illustrates an embodiment where two securing loops 92, 94 are provided. Each loop 92, 94 is placed around one upright member 40, 42 respectively. Again, the individual loops 92, 94 could be slid around the U-brackets 46, 48 of the frame 26, or they could be openable (e.g., buttons, hook and loop type fasteners, etc.). With solid loops 92, 94 it would be difficult and perhaps impossible for the seat cushion 30 to be removed while the frame 26 is secured to the bleacher, depending of course on how tightly the frame 26 engages the bleacher 12. In those cases where the cushion 30 could be removed or when using strap 90, the relevant straps could be further secured to the frame 26 and/or attachment bracket 44 with locking members (e.g., zip ties), if desired.

Figure 9:
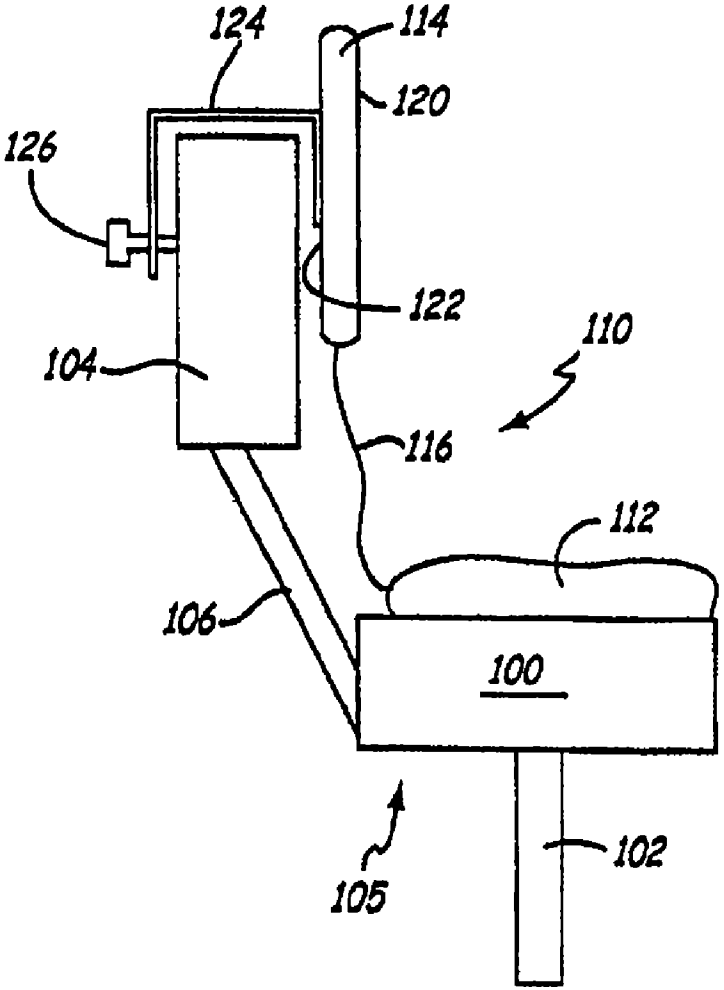
FIG. 9 is a side, planar view of a backed bleacher with a backed stadium seat attached.

FIG. 9 is a side, planar view of a backed bleacher 105 with a backed stadium seat 110 attached. A backed bleacher 105 is any stadium bleacher or bench type seat provided with a structure to support or abut a patron's back. The example illustrated includes a support member 102 and a bleacher seat 100. A bleacher back 104 is coupled to the bleacher seat by a back support column 106. Any number of arrangements are possible for backed bleacher seats and the back and seat portion may be integral, connected or completely separate.

The backed bleacher stadium seat 110 includes a seat cushion 112 which rests on the bleacher seat 100 to provide cushioned comfort to the patron. A back cushion 114 is connected to the seat cushion 112 by one or more flexible members. As illustrated, a first connecting strap 116 and a second connecting strap 118 act as the flexible member in this embodiment.

Figure 10:
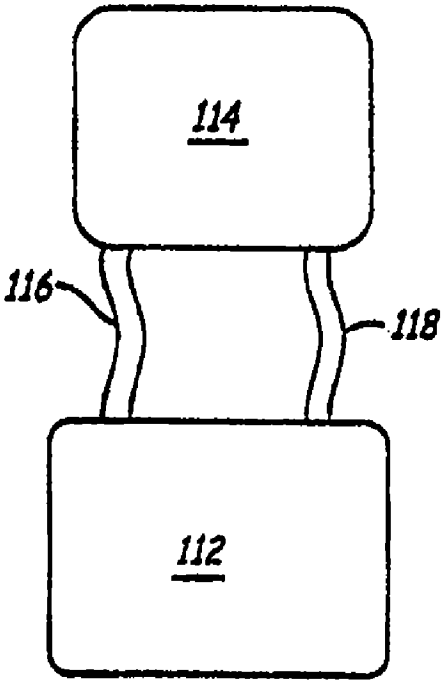
FIG. 10 is front/top planar view of the stadium seat for the backed bleacher.

The back cushion 114 includes a front surface 120 and an opposing rear surface 122 that is proximal the bleacher back 104. A back cushion bracket 124 securely couples the back cushion 114 to the bleacher back support 106. One such bracket 124 is illustrated and is sufficient for attachment; however, more than one bracket 124 (e.g., spacing two such brackets on opposite ends) may also be utilized to attach the back cushion 114. As the seat cushion 112 is coupled to the back cushion 114, the seat cushion is likewise retained proximate to the bleacher 105, though having some degree of permissible movement. FIG. 10 illustrates the interconnection between the back cushion 114 and the seat cushion 112, which are freely movable with respect to one another to the extent that the flexible connecting straps 116, 118 permit such a range of movement.

The backed bleacher stadium seat 110 can be attached to most any backed bleacher 105 to provide cushioned comfort for seating and for back support. As disclosed above, the stadium seat 110 could also be semi-permanently attached to the bleacher seat 105 by virtue of the bracket 124.

Figure 11:
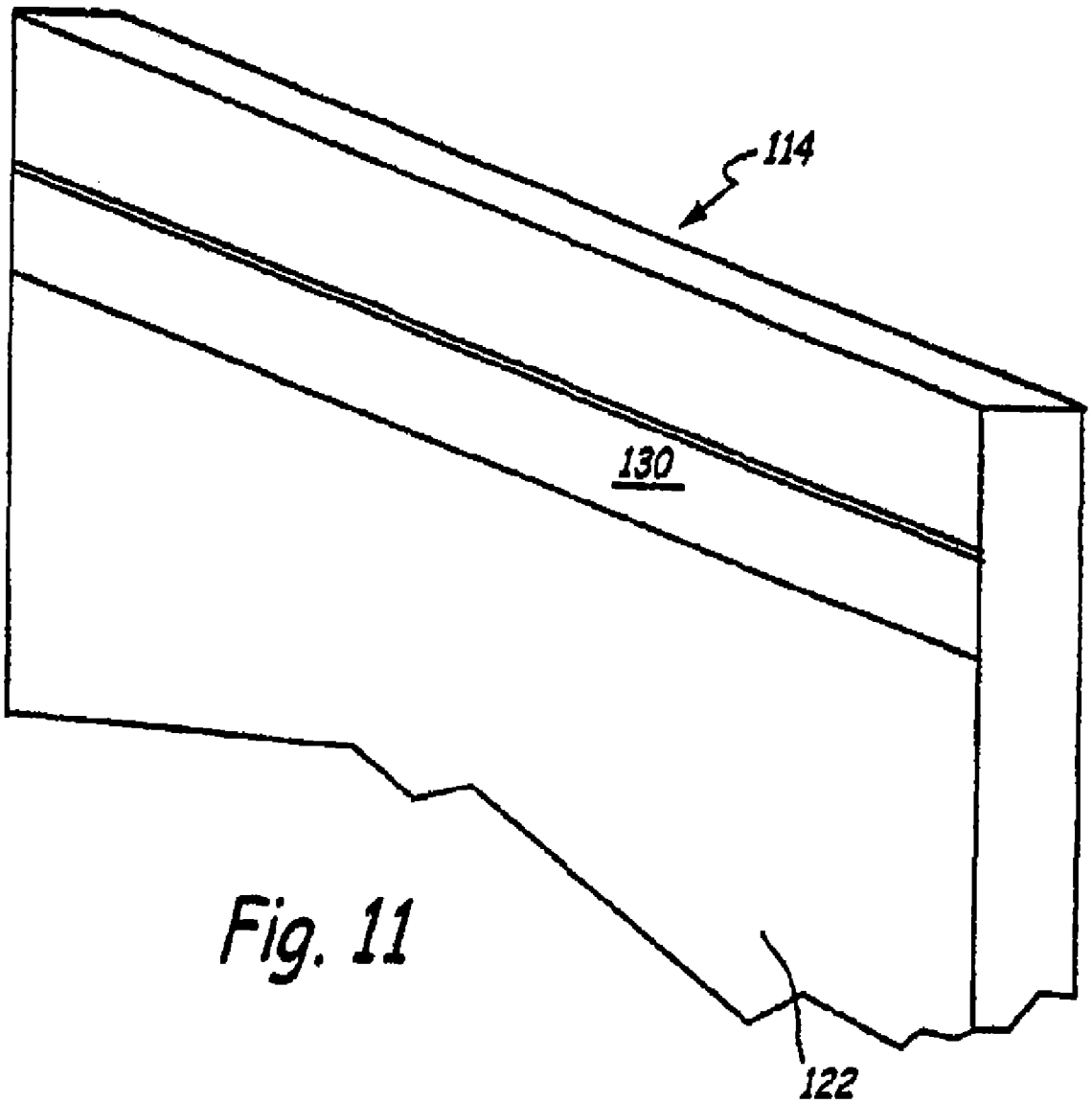
FIG. 11 is a isometric view of a portion of a back cushion of the stadium seat for the backed bleacher.
Figure 12:
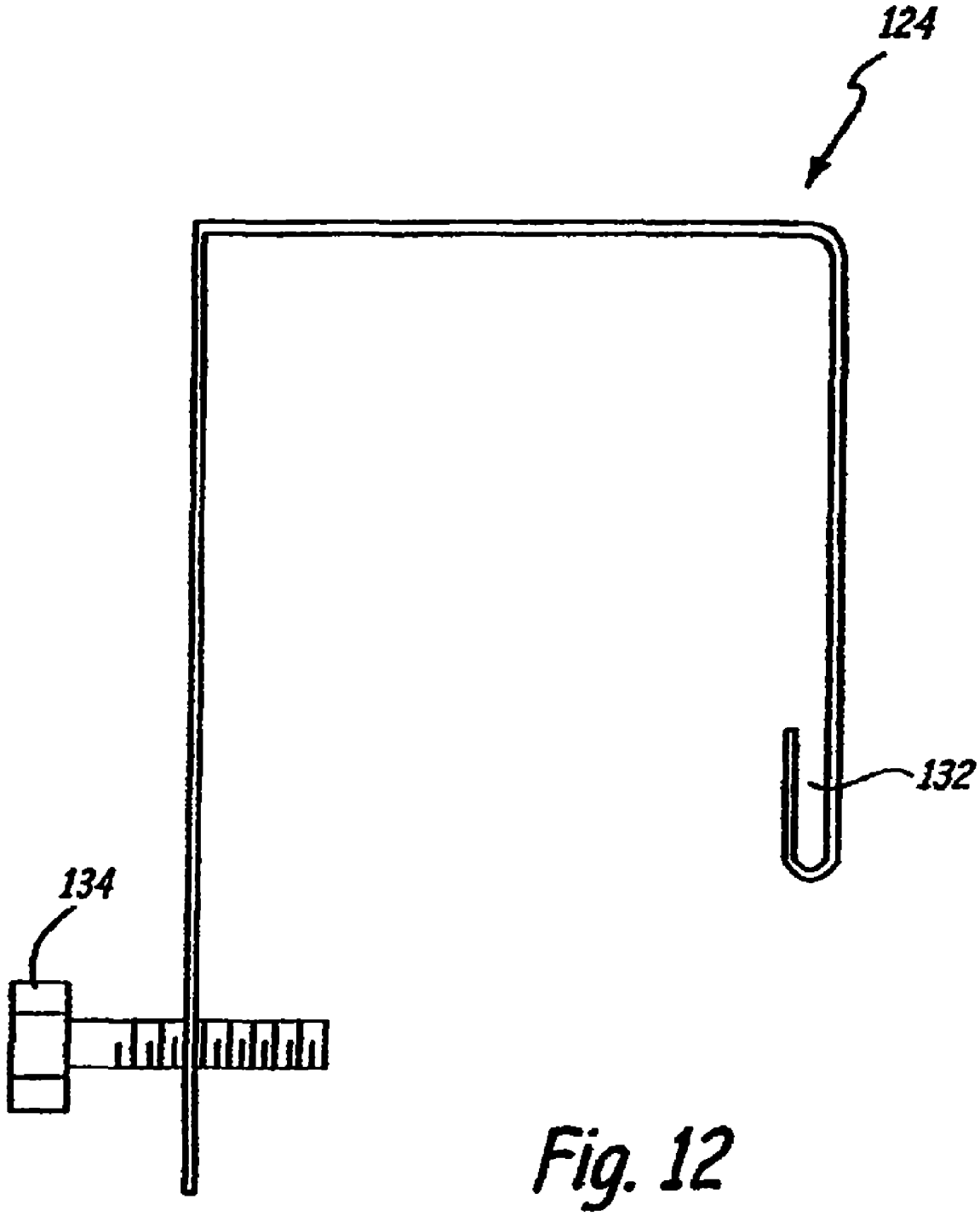
FIG. 12 is a side, planar view of a back cushion bracket for securing the stadium seat for the backed bleacher to the back rest portion of the bleacher.

FIGS. 11 and 12 illustrate one embodiment of the stadium seat 110 allowing for semi-permanent attachment. The rear surface 122 of the back cushion is provided with an attachment strap 130 that spans across at least a portion of the rear surface. As illustrated, strap 130 is provided from one vertical (as illustrated) edge to the opposite edge. This allows maximum adjustability.

A back cushion bracket 124 includes substantially C-shaped bracket having a strap loop 132 at one end and a threaded throughbore 135 at the other end for receiving a locking bolt 134. The bracket 124 is placed over the top portion of the bleacher back 104 (FIG. 9) and the locking bolt is advanced so as to exert pressure against the bleacher back 104 and hold the bracket 124 in place relative to the bleacher back 104. The attachment strap 130 of the cushion 114 is received by the strap loop 132, thus securing the back cushion 114. Depending upon the tension exerted, the back cushion may be horizontally slidable relative to the bleacher back 104; the amount of such movement being determined by the length and flexibility of the attachment strap 30.

In addition to using the stadium seat 110 on a backed bleacher, the seat 110 may also be used on a club seat. Club seats are often provided in stadiums and have a seat portion and a back portion forming a chair. The seat portion often folds upwards towards the back portion to allow more space in an aisle. The use of the stadium seat 110 on a club seat is substantially similar to the use described above. In addition, the seat cushion 112 may be provided with a strap (not separately shown) that is substantially similar to the attachment strap 130 provided on the back cushion 114 (FIG. 11). Such a strap could then be slid under the seat portion of the club seat, serving to retain the seat cushion 112 in place. This is particularly useful on those club seats that fold upwards, as the seat cushion 112 need not be repositioned or reattached each time the patron rises and the club seat folds.

Figure 14:
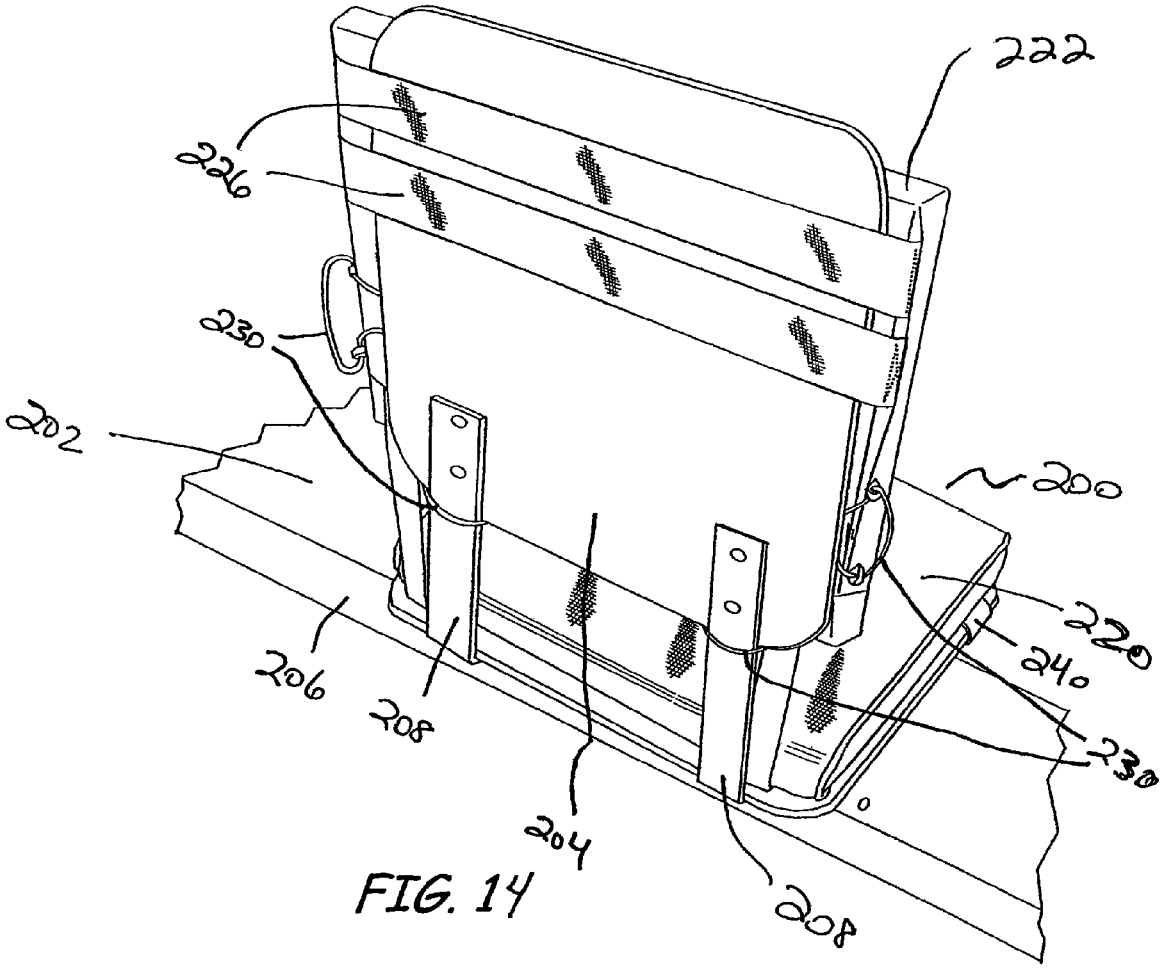
FIG. 14 is a rear perspective view depicting a cushion attached to a portion of a stadium seat, according to one embodiment of the present invention.

FIG. 14 is a perspective view of a stadium cushion 200 attached to a backed bleacher 202, according to an alternative embodiment of the present invention. In this embodiment, the backed bleacher has an separate bleacher back 204 for each seat. The bleacher back 204 is connected to the bench or bleacher 206 by back support elements 208.

Figure 15:
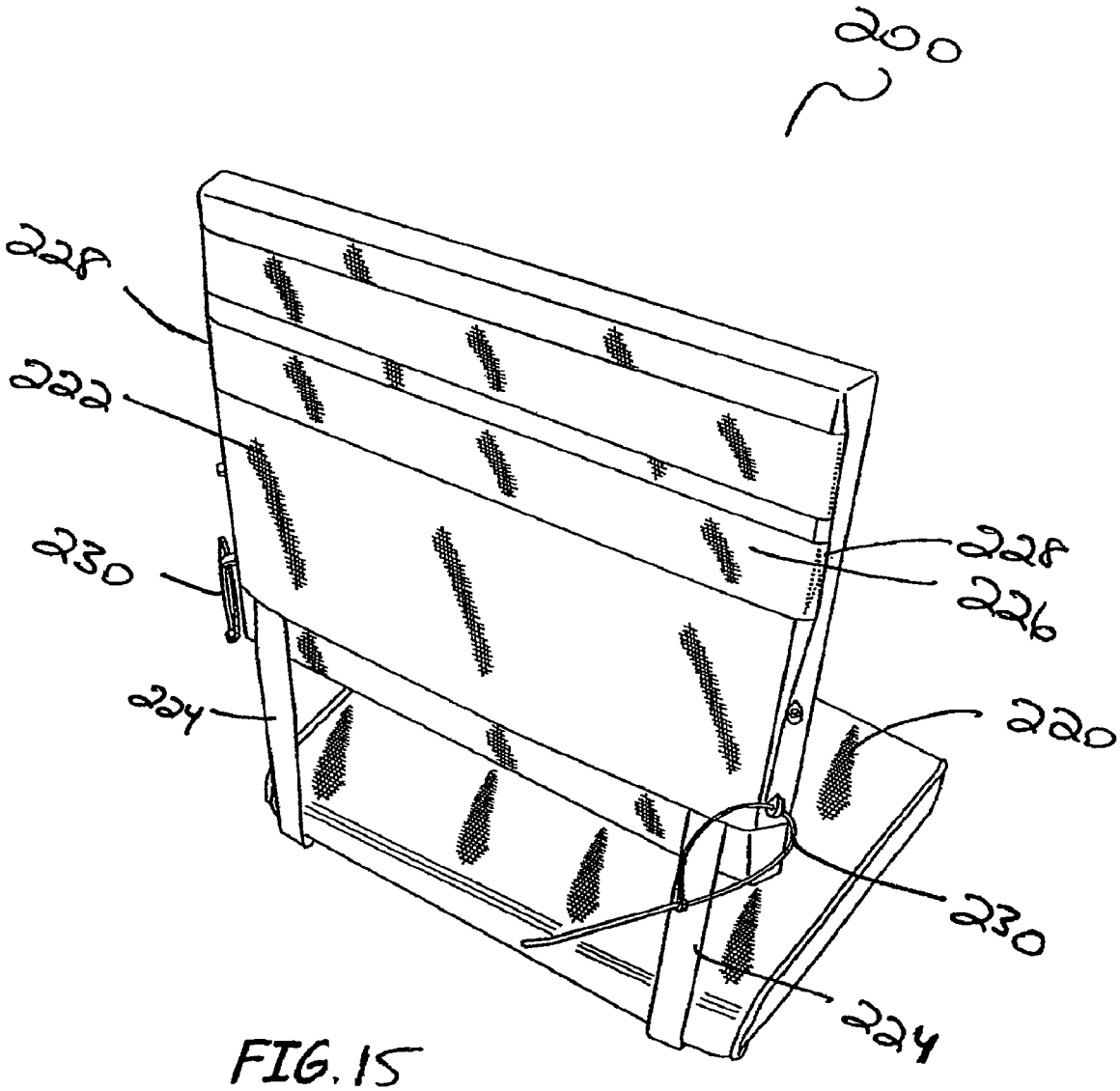
FIG. 15 is a rear perspective view showing a cushion, according to one embodiment of the present invention.

FIG. 15 is a rear perspective view of the stadium cushion 200, according to one embodiment of the present invention. The stadium cushion 200 has a seat cushion 220 and a back cushion 222 that are connected by two connection elements 224. The connection elements 224, in one aspect of the invention, are two flexible straps that allow for the respective positions of the two cushions 220, 222 to be varied for ease of use and transport. Alternatively, the connection elements 224 can be any known device allowing for flexible connection of the seat cushion 220 and the back cushion 222. In a further alternative, the connection element 224 can be a one element allowing for flexible connection of the two cushions 220, 222.

The back cushion 222 has a seat back attachment element 226. According to one embodiment, the seat back attachment element 226 is a stretchable strap that stretches along the back side of the back cushion 222 and is connected at each end 228 to the cushion 222. Alternatively, the seat back attachment element can be any known device for attaching the seat cushion 222 to the seat back 204.

The back cushion 222 also has support attachment elements 230. According to one embodiment, the support attachment elements 230 are adjustable plastic loops that are connected to the back cushion 222 on opposing sides of the back cushion 222. In one embodiment, the support attachment elements 230 are similar to zip ties. Alternatively, the support attachment elements 230 are any known devices for attaching the back cushion to the back support elements 208.

Figure 16:
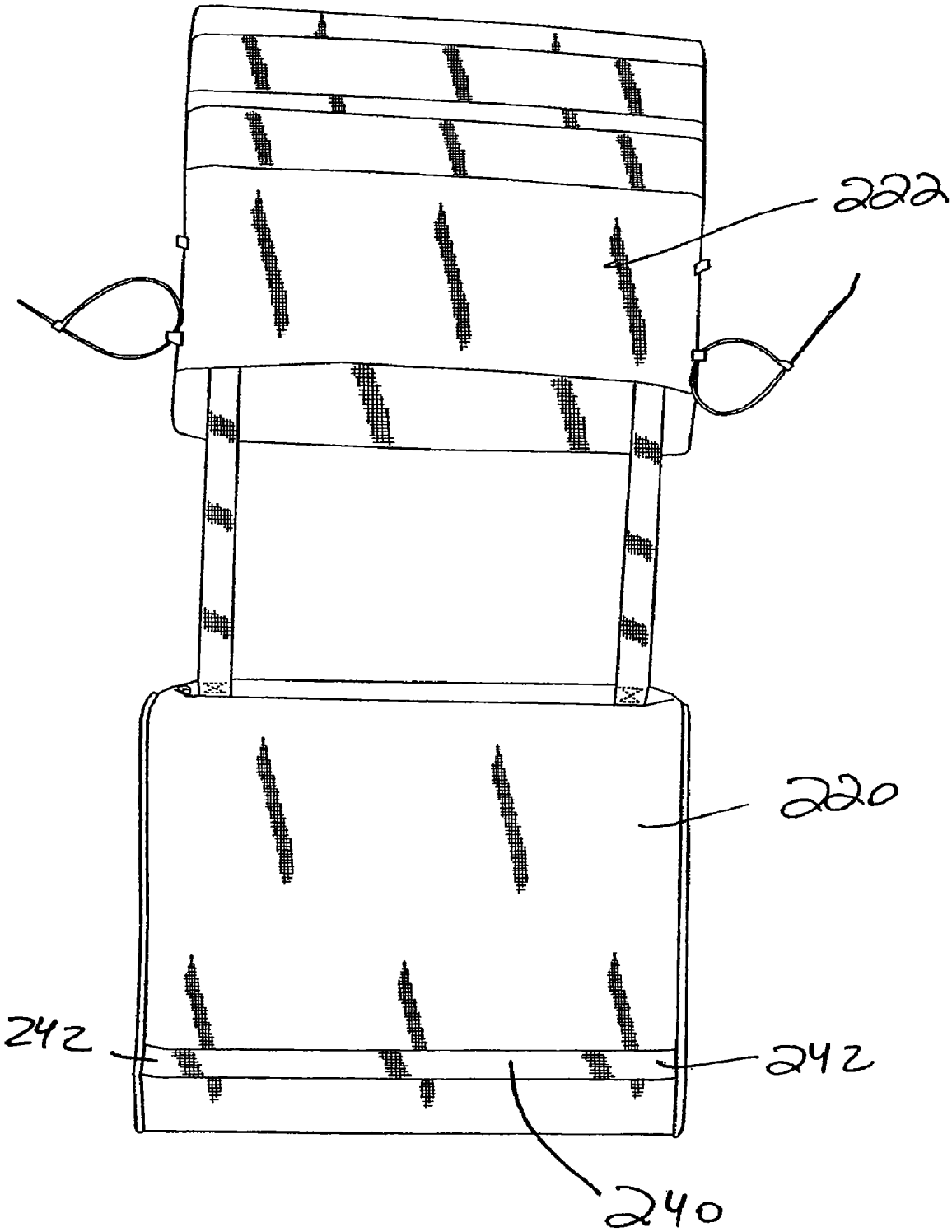
FIG. 16 is a back planar view illustrating a cushion, according to one embodiment of the present invention.

FIG. 16 depicts the back of the back cushion 222 and the underside of the seat cushion 220, according to one embodiment of the present invention. The underside of the seat cushion 220 includes a seat attachment element 240. According to one embodiment, the seat attachment element 240 is a stretchable strap that stretches along the underside of the seat cushion 220 and is connected at each end 242 to the cushion 220. Alternatively, the seat attachment element 240 can be any known device for attaching the seat cushion 220 to the bleacher seat 206.

In use, the stadium cushion 200 is configured to be used with several types of stadium seating. That is, the stadium cushion 200 can be attached to a bleacher seat with separate seat backs as shown in FIG. 14. The seat back attachment element 226 is stretched over the seat back 204 by positioning the back cushion 222 such that the seat back 204 is slid between the seat back attachment element 226 and the back cushion 222. The seat back attachment element 226 thereby stabilizes and maintains the position of the back cushion 222 in relation to the seat back 204.

In addition, the stadium cushion 200 according to one embodiment can be further attached to a stadium seat via the support attachment elements 230. Each element 230 can be attached to a back support element 208 as shown in FIG. 14. The back cushion 222 is thereby further stabilized.

Further, the stadium cushion 200 according to one aspect of the present invention is further attached to the stadium seat using the seat attachment element 240 as shown in FIG. 14. The seat attachment element 240 is stretched over the seat 206 by positioning the seat cushion 220 such that the seat 206 is slid between the seat attachment element 240 and the seat cushion 220. The seat attachment element 240 thereby stabilizes and maintains the position of the seat cushion 220 in relation to the seat 206.

Alternatively, the stadium cushion 200 could also be attached to any club seat as described herein. In a further alternative, the stadium cushion 200 is intended to be attachable to several other types of stadium seating.

Shown generally in the drawings is an additional alternative embodiment of a seat cushion 310 that is suitable for attachment to a bleacher 312 (shown in phantom lines), or other similar base portion. As will be seen in the drawings and following description, the seat cushion 310 is adapted for quick and convenient attachment to a bleacher 312 in a semi-permanent fashion to provide a comfortable seat that provides padding and back support for a user.

Figure 17:
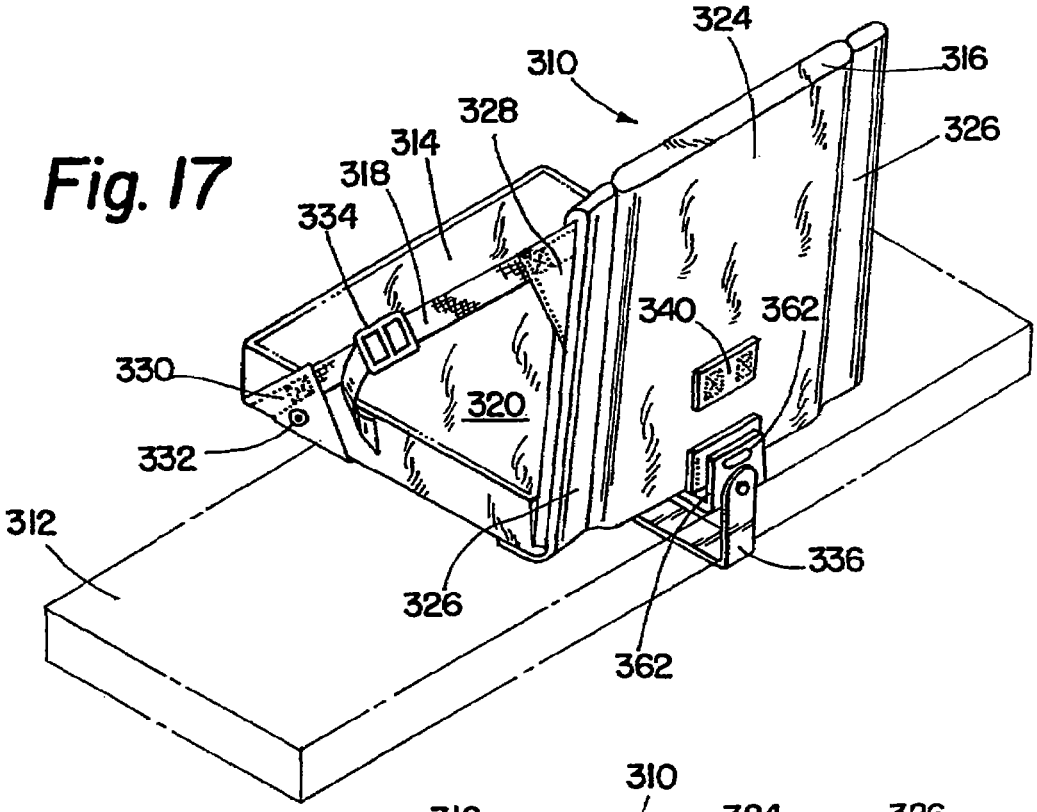
FIG. 17 is an isometric view of a seat cushion according to one embodiment of the present invention.

FIG. 17 is an isometric view of a seat cushion 310 according to one embodiment of the present invention. The top portion of a bleacher 312 is indicated in phantom lines. It should be appreciated that the seat cushion 310 could be modified to fit a variety of sizes and shapes of bleachers, or other support structures. The seat cushion 310 includes a bottom portion 314 and a back portion 316. The bottom cushioned portion 314 provides a padded surface on which a user may sit, and the back portion 316 provides a backrest to provide support for a user's back.

The bottom portion 314 is a padded cushion. It may include a covering 320 surrounding and protecting a pad 322 (not visible in FIG. 17, see FIG. 24). The covering 320 may be made of any suitable protective material. Most preferably the material will be flexible, durable, comfortable to sit on, and weather resistant. Preferably, it will not fade excessively, or degrade significantly from prolonged exposure to sunlight, and other elements. Suitable coverings 320 may include nylon fabric, vinyl, canvass, rubber, and the like. It may be desired to match the coloring of the covering 320 with the color of the bleacher 312, or with the color scheme of a school or team. The covering 320 could be decorated with a logo, name, or other image, if desired. The pad 322 is included to provide a comfortable cushioning layer between a user and a bleacher 312. The pad 322 may be made from any suitable cushioning material such as sponge, foam rubber, synthetic stuffing, and the like. It should be thick enough to provide comfortable cushioning, but not so thick as to unduly raise the height of the seating surface. Preferably it is deep enough to cover the entire depth of the bleacher 312. It should be wide enough to provide a comfortable space for a user to sit. The pad 322 may be generally flat, or may be contoured to match a user's anatomy.

The back portion 316 includes a central cushioned portion 324 between two riser portions 326. The central cushioned portion 324 is formed similarly to the bottom portion 314 described above. It has a covering 320 around a pad 322 (not shown in FIG. 17, see FIG. 24). The riser portions 326 provide support and stability to the central cushioned portion 324. The bottom portion 314 and the back portion 316 are preferably joined together in a hinged or pivotal relationship, near a back end of the bottom portion 314 and a bottom end of the back portion 316.

A gusset 328 is provided near the top of each riser 326. This gusset 328 serves as an attachment point for a flexible belt 318. A similar triangular gusset 330 is provided near the front of the bottom portion 314, and serves as an attachment and reinforcement point for the flexible belt 318 to the bottom portion 314. The gussets 328 and 330 are preferably made of a strong, flexible material similar to the covering 320. They may be attached to the covering 320 of their respective cushioned portions 314 and 316 by sewing, riveting, adhesive or other fastening mechanisms known to those of skill in the art. Alternatively, the gussets 328 and 330 may be formed from the same piece of material as their respective coverings. The lower gusset 330 is provided with an eyelet 332, which is preferably in the form of a reinforced grommet made of metal or plastic.

Belt 318 is preferably adjustable in length. As such, the belt 318 may be formed by two separate straps connected by a buckle 334. Other mechanisms for lengthening and shortening the belt will be known to those of skill in the art, for example, a hook and loop fastener such as commonly sold under the trade name Velcro. The belt 318 acts as a flexible constraint element for restraining the back portion 316 from rotating beyond a desired angle with respect to the bottom portion 314. The belt 318 should be made from a thin, flexible material that is sufficiently strong to maintain the desired angle between the bottom portion 314 and the back portion 316 when a user sitting on the bottom portion 314 leans back against the back portion 316. The preferred material is a nylon belt, but other materials may be acceptable as well.

An attachment clamp 336 is used to fasten the seat cushion 310 to the bleacher 312. A patch 338 may be applied at the rear bottom of the back surface of the bottom portion 314 in order to protect and reinforce the covering 320 against contact with the attachment clamp 336. A loop 340 may be provided on the back surface of the bottom portion 314 in alignment with and above the attachment clamp 336. A zip tie 375 (see FIG. 24) or other fastener (not shown) may be threaded through the loop 340 to connect it with the attachment bracket 336 in order to maintain the back portion 316 in a generally upright orientation.

Figure 18:
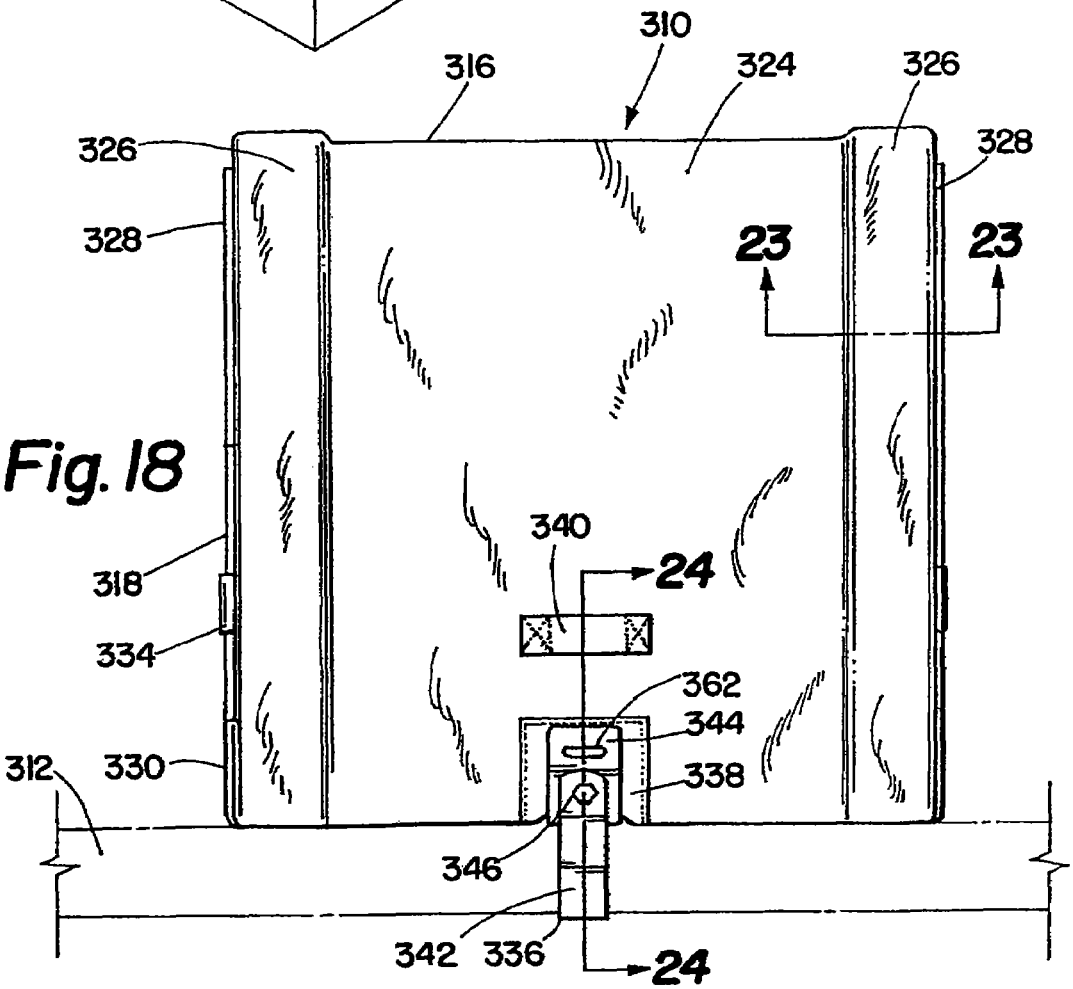
FIG. 18 is a rear elevation view of the seat cushion according to FIG. 17.
Figure 19:
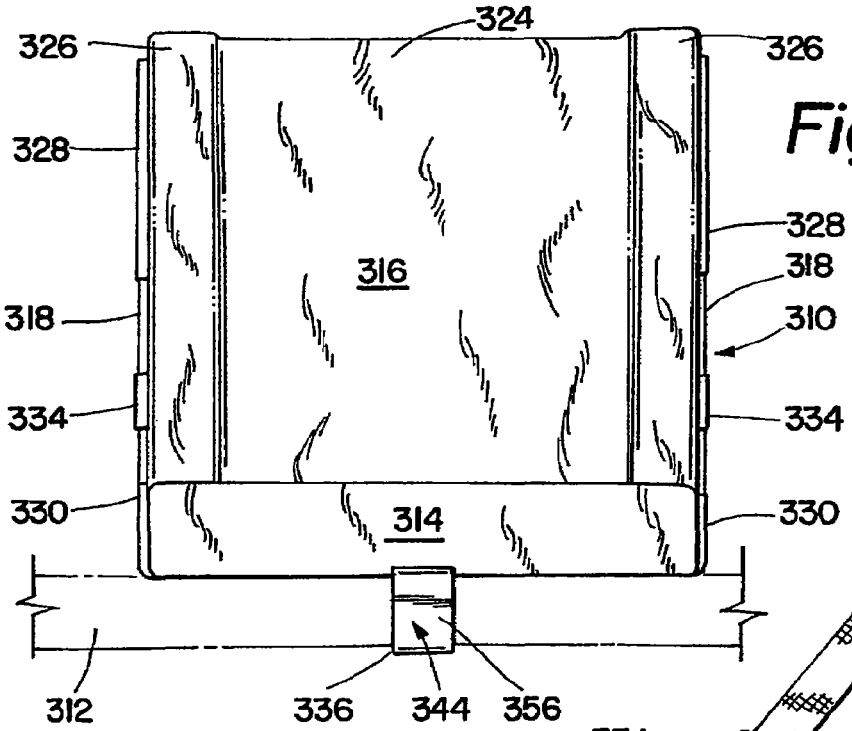
FIG. 19 is a front elevation view of the seat cushion according to FIG. 17.

FIG. 18 is a rear view of the seat cushion 310 shown in FIG. 17. FIG. 19 is a front view of the seat cushion 310 shown in FIG. 17. As can be seen in FIGS. 2 and 3, in use, the seat cushion 310 rests flat against the top surface of a bleacher seat 312. Specifically, the bottom surface of the bottom portion 314 rests on top of the bleacher 312. As seen in FIG. 18, attachment clamp 336 includes a rear jaw 342 that extends below and engages the bleacher 312. A front jaw 344 extends all the way to the front of the bleacher 312, and is visible in both FIGS. 2 and 3. A threaded fastener 346 is used to join the two jaws 342 and 344 together. Preferably the jaws 342 and 344 are made from steel bent into the desired shape. The jaws 342 and 344 should be durable, rigid, and resistant to corrosion.

Figure 20:
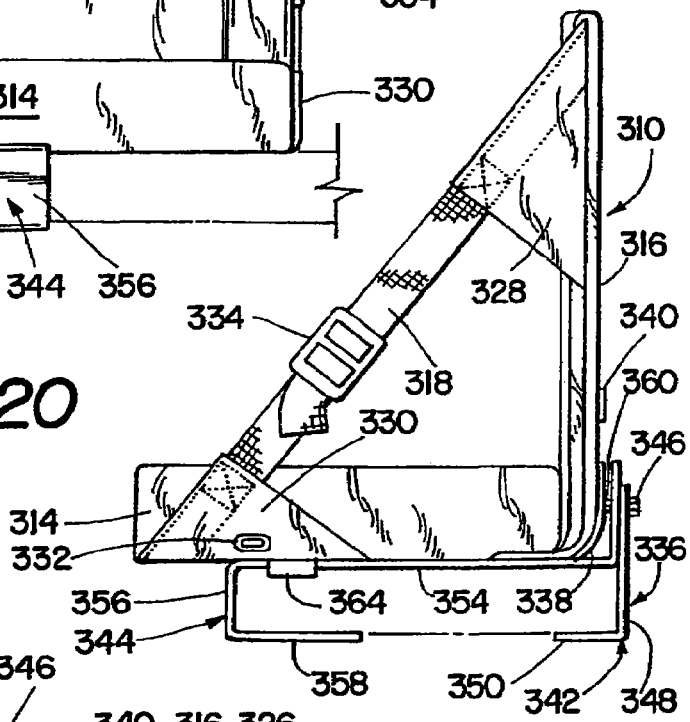
FIG. 20 is a side elevation view of the seat cushion according to FIG. 17.
Figure 24:
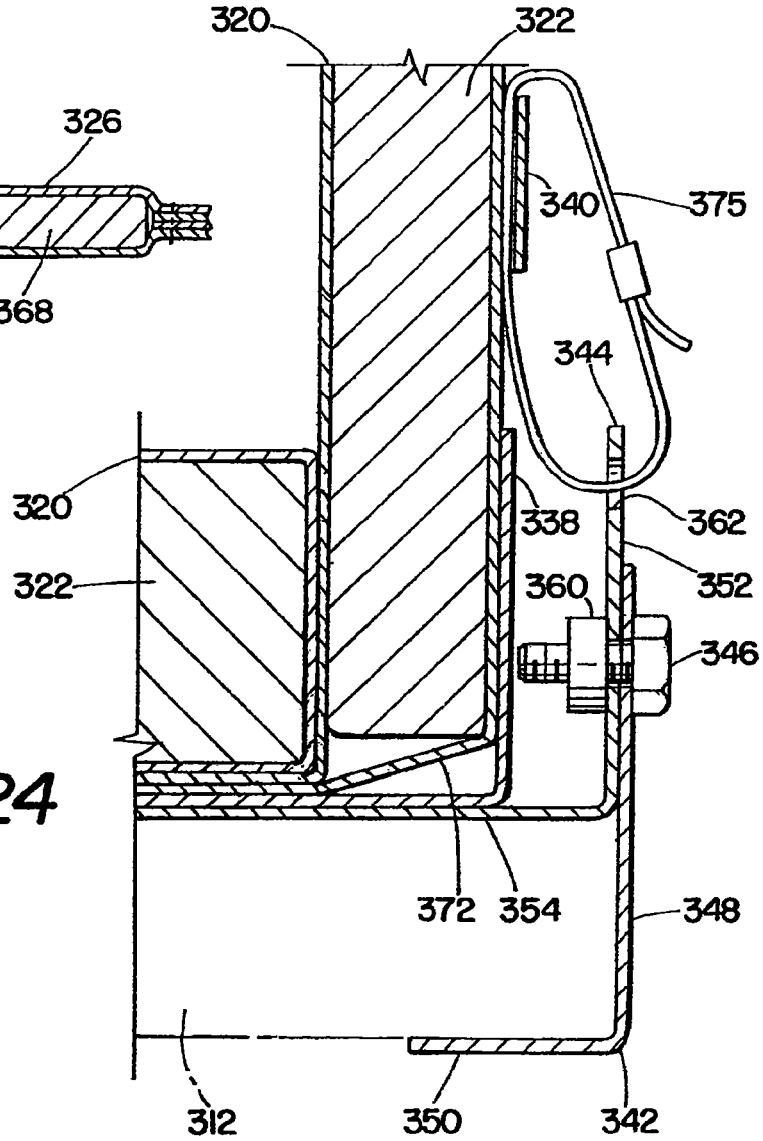
FIG. 24 is a partial sectional view taken along line 24-24 of FIG. 18, including a zip tie retaining the backrest in an upright orientation.

The features of the attachment clamp 336 are best seen in FIGS. 20 and 24. With reference to FIG. 20, it can be seen that the rear jaw 342 is a generally L-shaped bracket that includes a vertical leg 348 and a horizontal leg 350. In use, the rear jaw 342 wraps around and engages a rear portion of the bleacher 312. With further reference to FIG. 20, it can be seen that the front jaw 344 is a bracket with a somewhat serpentine cross section. It has a rear vertical leg 352, a long horizontal leg 354, a front vertical leg 356, and a front horizontal leg 358. Threaded fastener 346 engages a threaded receiver 360 to fasten the rear jaw 342 to the front jaw 344, and thereby clamp the bleacher 312 between the jaws 342 and 344. The threaded receiver 360 may be a loose nut. More preferably, the threaded receiver 360 is fixed, as by welding, to the rear vertical leg 352 of the front jaw 344. It should be appreciated that the orientation of the threaded fastener 346 and the threaded receiver 360 could be reversed, though the orientation shown is preferred for ease of access to the head of the threaded fastener 346, and so that the end of the threaded fastener 346 does not extend into an area between bleachers 310 where people may be walking and catch their legs on the exposed end. In the preferred orientation shown, patch 338 reinforces and protects covering 320 from snagging or wearing from contact and rubbing with the end of the threaded fastener 346 and the front jaw 344. The rear vertical leg 352 of the front jaw 344 extends higher than the vertical leg of the rear jaw 342, and includes a slot 362 near its top end. It should be appreciated that the relative heights of the rear vertical legs 348 and 354 reversed, and the slot 362 could be provided in the rear jaw 342 as an alternative.

Figure 22:
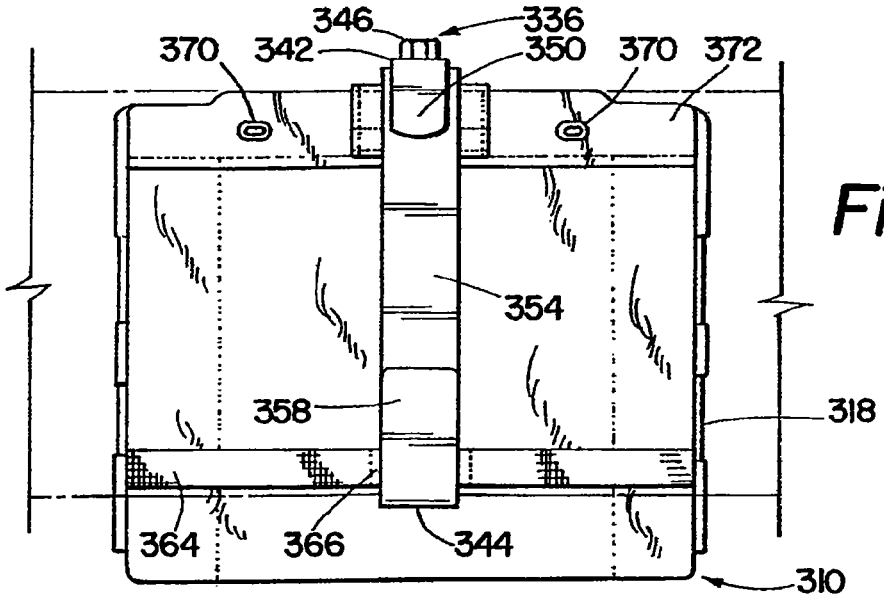
FIG. 22 is a bottom plan view of the seat cushion according to FIG. 17.

As best seen in FIG. 22, the bottom surface of the bottom portion 314 includes a belt 364 with a loop 366 formed about midway across the width of the seat bottom portion 314. The loop 366 is formed in the shown embodiment by leaving a central portion of the belt 364 loose, or unstitched, from the bottom surface of the bottom portion 314. The loop 316 is used to attach the seat 310 to the attachment clamp 336. Specifically, the front jaw 344 is threaded through the loop 366 until the loop 316 is in the position shown in FIG. 20 on the long horizontal leg 354.

The back portion 316 and the bottom portion 314 are connected in a hinged or pivotal relationship. In the embodiment shown, a hinge 372 is formed by the covering 320. Specifically, as seen in FIG. 24, a single piece of material is used form the covering 320 for both the back portion 316 and the bottom portion 314. A gap, or space, is left between the pads 322 of the back 314 and bottom 314 portions within the covering 320. This gap provides a flexible portion that acts as a hinge 372. Alternatively, the back portion 316 and bottom portion 314 could be formed separately and joined together by a separate hinge structure.

The hinge portion 372 of the embodiment shown includes a pair of openings 370 visible in FIG. 22. These openings 370 are preferably reinforced by metal or plastic grommets or eyelets. These openings 370 provide additional attachment points for fasteners, as well as providing drainage ports for water that could otherwise collect in the hinge portion 372.

Figure 21:
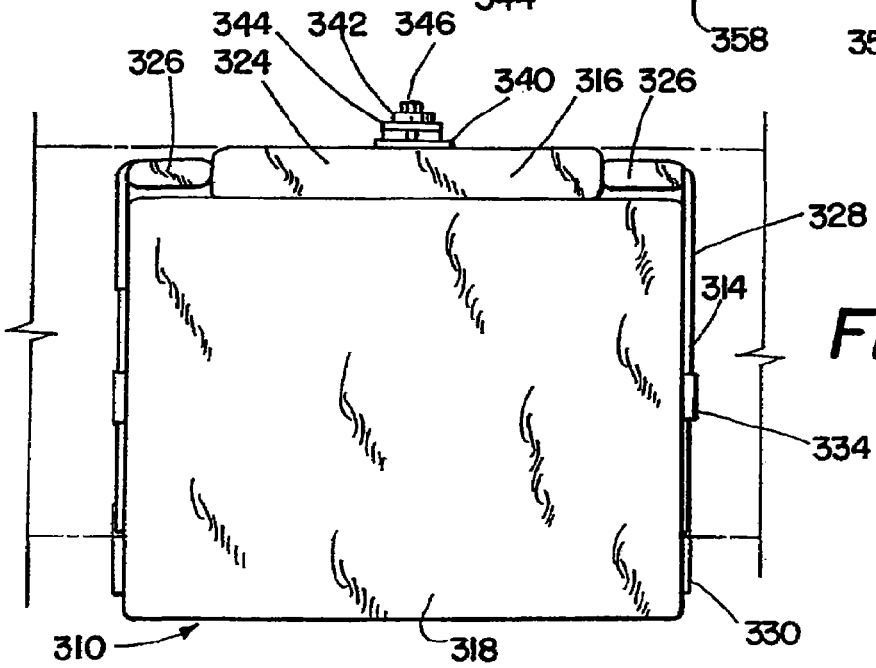
FIG. 21 is a top plan view of the seat cushion according to FIG. 17.
Figure 23:
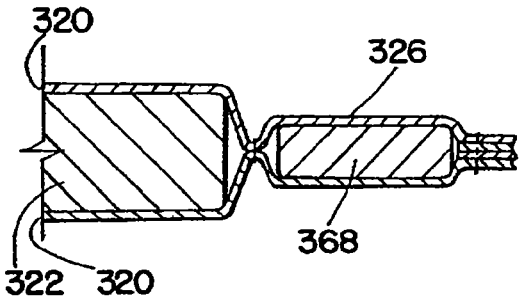
FIG. 23 is a partial sectional view taken along line 23-23 of FIG. 18.

The back portion 316 includes a pair of riser portions 326 on opposite ends, as seen in the top view of FIG. 21. The riser portions 326 provide support for the central cushioned portion 324 that acts as an ergonomic back rest. The riser portions 326 may be formed from any suitable structure that provides vertical and lateral support for the central cushioned portion 324. In the embodiment shown, riser inserts 368 are sewn within pockets formed in the covering 320, as shown in the cross-sectional view of FIG. 23. These riser inserts 368 may be formed from relatively rigid materials such as hard plastic, wood, or metal.

There are no cross members across the back portion 316. Instead, the entire structural support for the back portion 316 is provided by the riser portions 326, the pad 322, and flexible belts 318.

Attachment of the seat cushion 310 to the bleacher 312 is accomplished as follows. First, the seat cushion 310 is connected to the attachment clamp 336 by threading the front jaw 344 through the loop 366 in belt 364 on the bottom surface of the bottom portion 314. The front jaw 344 may then be placed in engagement with the bleacher 312 in the desired location with the front portion of the bleacher 312 retained by the front horizontal leg 358 and front vertical leg 356 of the front jaw 344. The long horizontal leg 354 should rest on the top surface of the bleacher 312 and should run generally from the front of the bleacher 312 to the rear of the bleacher 312 in a generally perpendicular alignment. The rear jaw 342 can then be secured to the front jaw 344 by inserting threaded fastener 346 though the rear jaw 342 into the threaded receiver 360 and then tightening the threaded fastener 346. A wrench may be used to provide additional leverage in tightening the threaded receiver 360. The bleacher 312 should be securely captured between the front jaw 344 and the rear jaw 342, thereby fastening the attachment clamp 336 to the bleacher 312. The seat cushion 310 is secured to the clamp 336 by virtue of loop 366 being retained by the long horizontal leg 354. To further secure the seat cushion 310 to the clamp 336, a zip tie, or similar attachment may threaded between loop 340 on the rear of the back portion 316 and the slot 362 near the top of the vertical leg 348 of the rear jaw 342.

The belts 318 can be adjusted to limit the distance the back portion 316 will pivot rearward. Typically a user will adjust the belts 318 so that the back portion 316 will not pivot much beyond a perpendicular orientation. When not in use, the belts 318 may be shortened to that the back portion 316 retained close to the bottom portion 314 in a closed storage position. In this closed storage position the back portion 316 covers and protects a portion of the bottom portion 314 from rain, dust, and sun exposure to improve the life of the bottom portion 314. The overall profile of the seat cushion 310 is also lowered in the closed storage position, to reduce the strain caused by wind.

When the seat cushion 310 is in place on the bleacher 312, it allows a user to sit more comfortably than on a plain bleacher 312. The bottom portion 314 provides cushioning and the back portion 316 provides support for the user's back. Because there are no hard cross members spanning across the back portion person's walking, sitting, or standing in the aisle behind the seat cushion 310 need not worry about banging their shin or other part of their leg on a hard cross-member.

The seat cushion 310 may be easily removed from the bleacher 312 for storage. It is contemplated that users may leave the seat cushion 310 in place on the bleacher 312 during an entire season, and then remove the seat cushion 310 during the off season. Of course, user's may choose to leave the seat cushion 310 attached more or less permanently, or may be removed after each event. To remove the seat cushion 310, the threaded fastener 346 is loosened, typically with a wrench, and the jaws 342 and 344 of the clamp 336 are spread apart and disengaged from the bleacher 312.

Shown generally in FIGS. 25-34 is an embodiment of a cushioned seat 410 that is suitable for removable attachment to a bleacher seat 412 or similar base. The cushioned seat 410 is adapted for quick and convenient attachment to a bleacher 412 in a semi-permanent fashion to provide a comfortable seat that provides padding and back support for a user. The cushioned seat 410 is well-suited for attachment to the bleacher even in instances where a portion of the bleacher may be obstructed.

Figure 25:
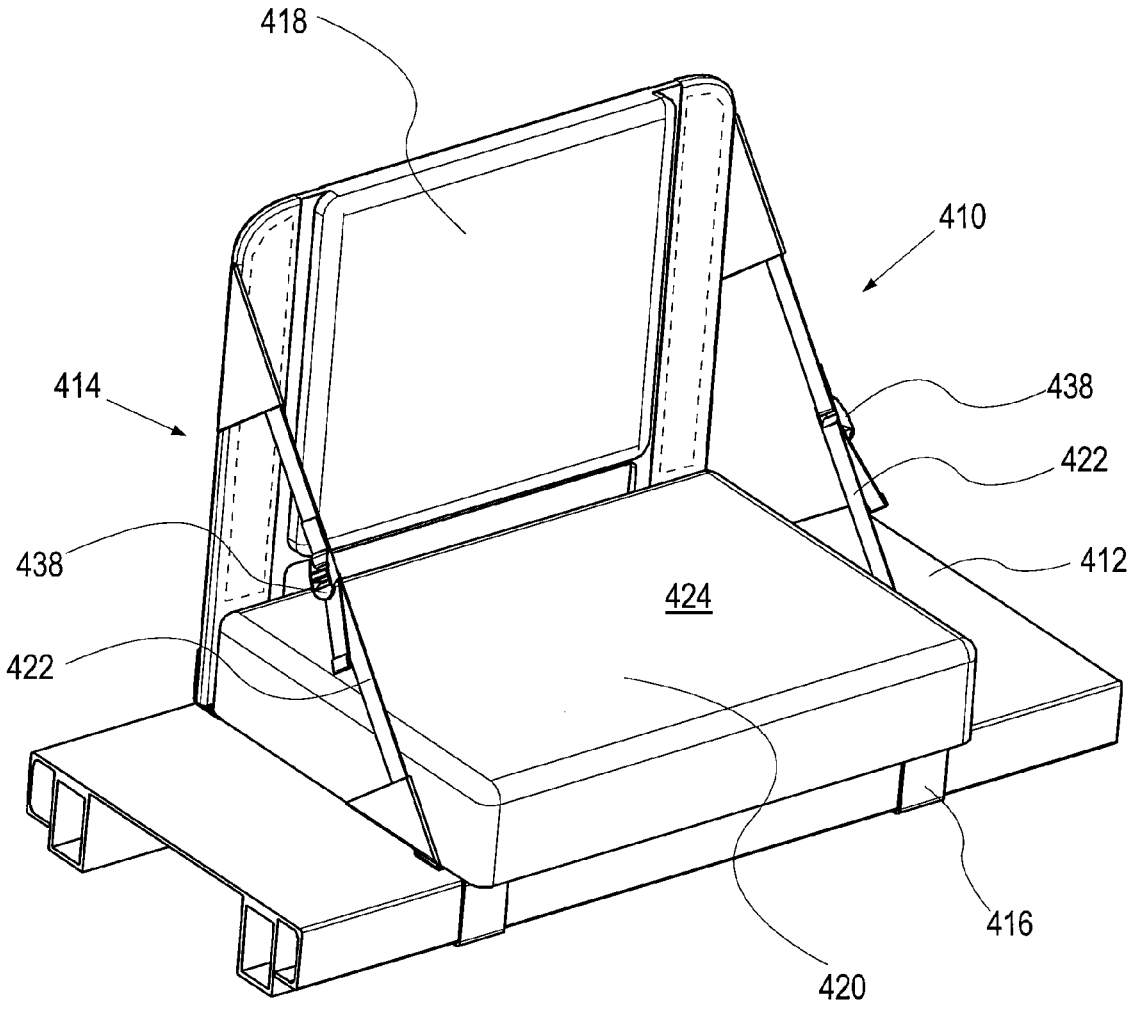
FIG. 25 is a front prospective view of a cushioned seat according to another embodiment of the present invention attached to a bleacher seat.

FIG. 25 shows the cushion seat 410 attached to a bleacher seat 412. The cushion seat 410 could be modified to fit a variety of sizes and shapes of bleacher, or other support structures. The cushion seat 410 includes a seat cushion 414 and an attachment bracket 416 that is used to attach the seat cushion 414 to the bleacher seat 412. The seat cushion 414 includes a backrest 418 and a bottom cushion 420. As seen in FIG. 25, when the cushion seat 410 is attached to the bleacher 412, the bottom cushion 420 provides a padded surface on which a user may sit, and the backrest 418 provides a support for a users back. Flexible straps 422, which may be nylon belts or the like, restrain the backrest 418 to provide support when a user leans back against the backrest 418. Buckles 438 may be used in order to adjust the length of the flexible straps 422, and thereby the angle of the backrest 418 relative to the bottom cushion 420.

Figure 26:
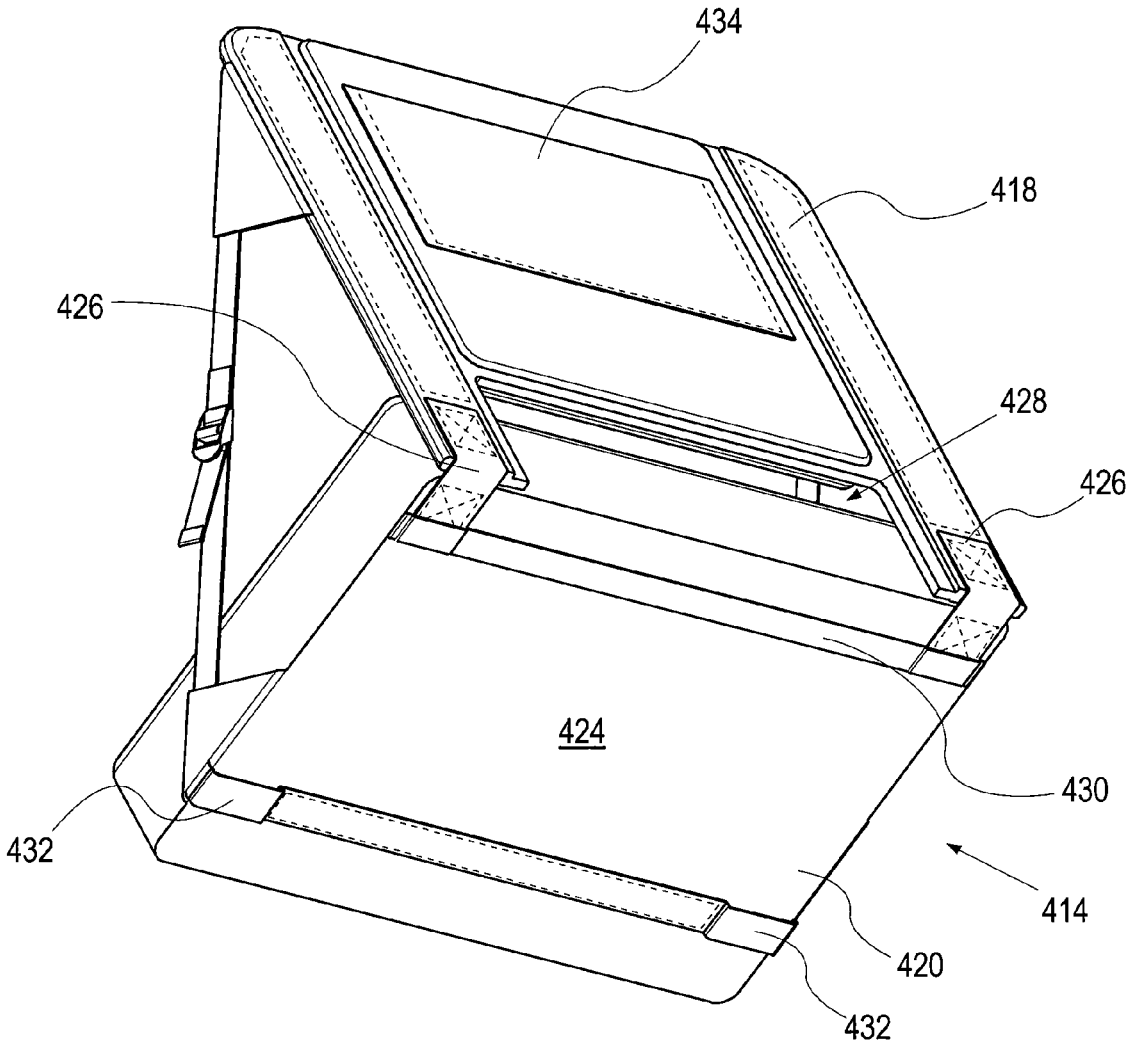
FIG. 26 is a rear prospective view of the seat cushion portion of the cushioned seat of FIG. 25 removed from the bleacher seat.
Figure 27:
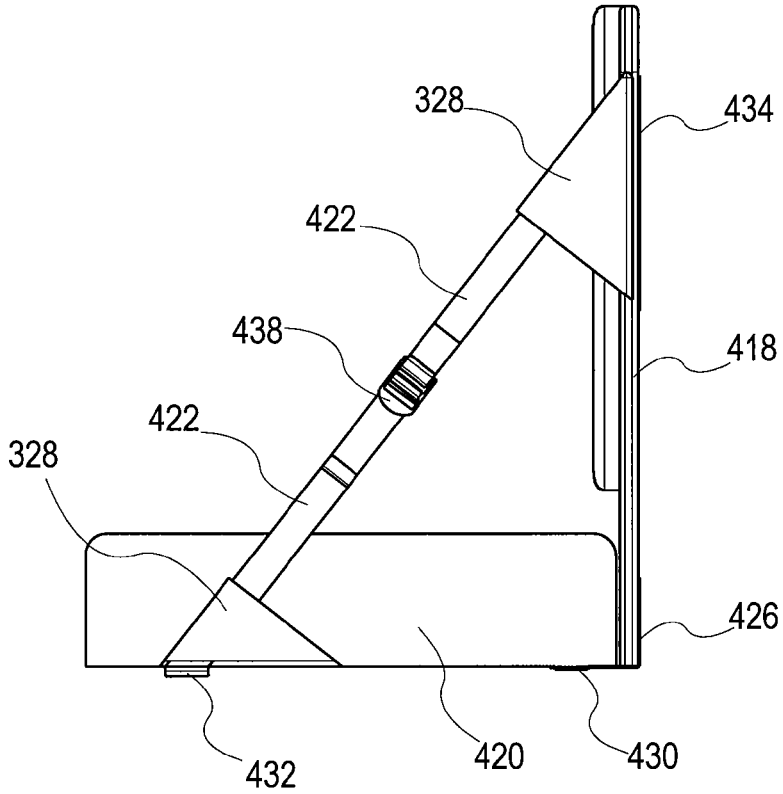
FIG. 27 is a side elevation view of the seat cushion of FIG. 26.
Figure 28:
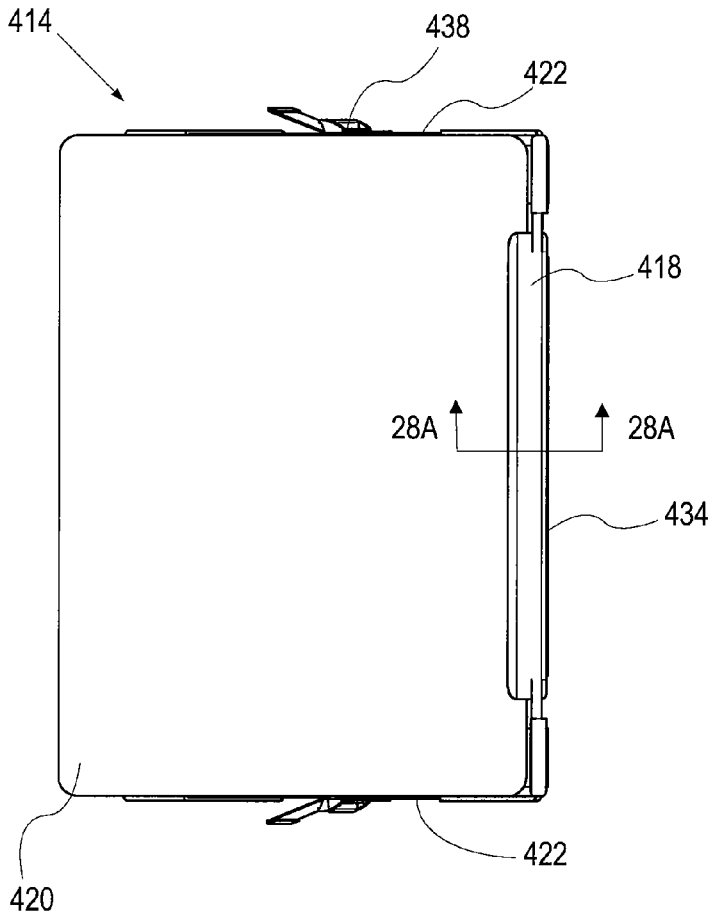
FIG. 28 is a top plan view of the seat cushion of FIG. 27.
Figure 28A:
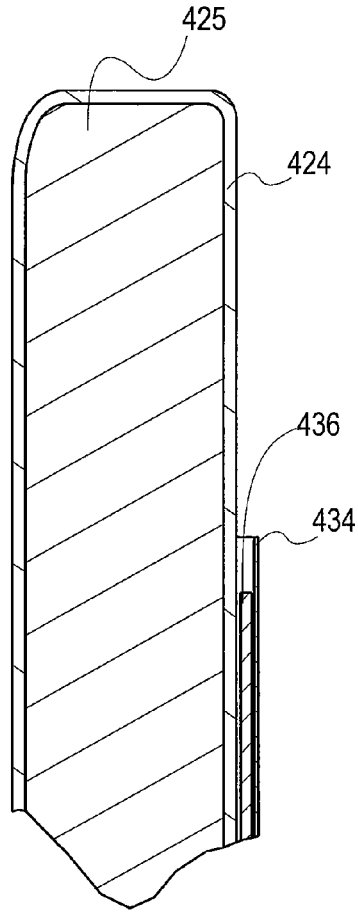
FIG. 28A is a partial detail cross-section view taken along line 28A-28A of FIG. 28.
Figure 29:
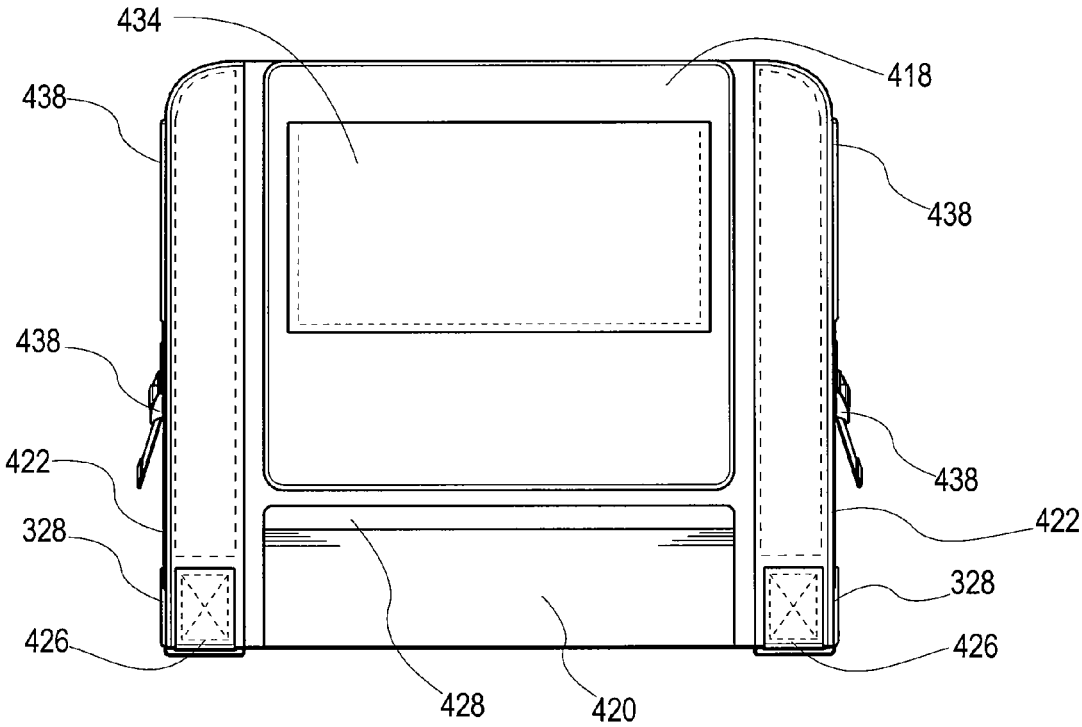
FIG. 29 is a rear elevation view of the seat cushion of FIG. 26.
Figure 34:
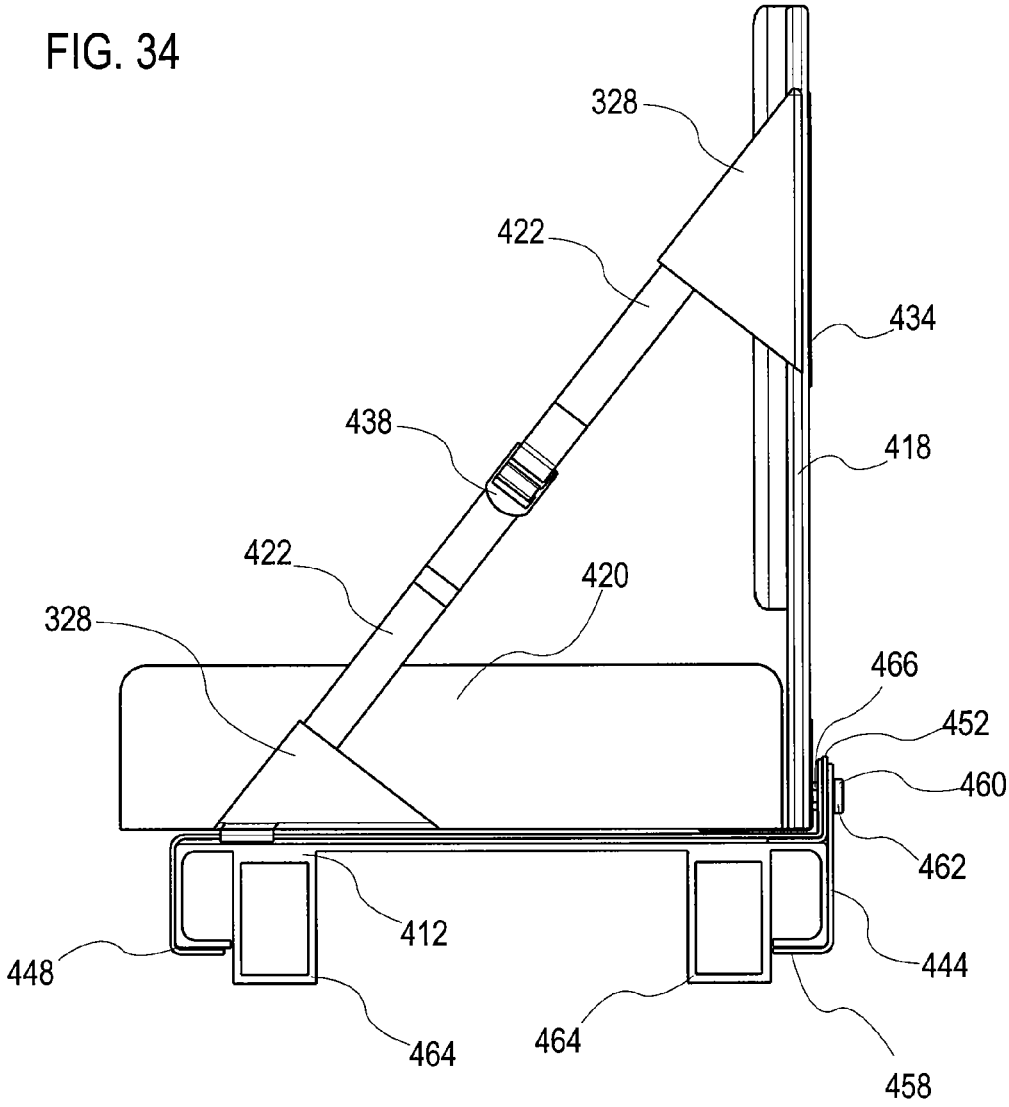
FIG. 34 is a side elevation view of the seat cushion and bracket attached to a bleacher of FIG. 25.

FIG. 26 shows the seat cushion 414 removed from the bleacher 412. The bottom cushion 420 may include a covering 424 that surrounds and protects a pad 425 (see FIG. 28A). The covering 424 may be made of any suitable protective material. Preferably, the material would be flexible, durable, comfortable to sit on, and weather resistant. Preferably, it will not fade excessively, or degrade significantly from prolonged exposure to sunlight, and other elements. Suitable materials for covering 424 may include nylon fabric, vinyl, canvass, rubber, leather, and the like. It may be desirable to match the coloring of the covering 424 with the color of the bleacher 412, or with the color scheme of a school or team. The covering 424 could be decorated with a logo, name, or other image. The pad provided within the covering 424 may be made from any suitable cushioning material such as sponge, foam rubber, synthetic stuffing, and the like. It should be thick enough to provide comfortable cushioning, but not so thick as to unduly raise the height of the seating surface. Preferably it will be deep enough to cover the entire depth of the bleacher 412, and will be wide enough to provide a comfortable space for a user to sit on. The pad may be generally flat, or may be contoured to match a user's anatomy. The pad may be sewn or bonded within the covering 424, or the covering 424 may be provided with a zipper or other closable opening into which the pad may be inserted. The backrest 418 is flexibly connected with the bottom cushion 420, for example by fabric hinges 426. Fabric hinges 426 may be provided by strips of fabric that are attached, as by sewing, rivet, adhesive, or other known methods at corresponding portions of the bottom cushion 420 and backrest 418. The backrest 418 may be formed with an open area 428 between the hinges 426. This open area 428 is useful for providing a space for a portion of the attachment bracket 416 without interference with the backrest 418.

The bottom of the bottom cushion 420 is provided with a rear loop 430 and a pair of front loops 432. These loops 430 and 432 act as an attachment mechanism to capture portions of the attachment bracket 416 in order to attach the cushion seat 410 to the attachment bracket 416. The loops 430 and 432 may be formed by any suitable flexible durable material that is suitable for receiving and capturing the attachment bracket 416. For example, the loops 430 and 432 may be formed by fabric belts that are sewn, or otherwise adhered to the bottom of the bottom cushion 420. In the preferred embodiment shown, the rear loop 430 expands across the entire, or nearly entire, width of the bottom cushion 420. The front loops 432 are offset from each other and are preferably provided near the outer edges of the bottom surface of the bottom cushion 420. The front loops 432 may be formed from a single belt that is stitched or otherwise attached to the bottom of the bottom cushion 420 with two loops formed. Alternatively, the front loops 432 may be formed as a single loop similar to the rear loop 430. The advantage to having two front loops 432 is that is helps maintain the cushion seat 410 more securely in place against sliding or twisting on the attachment bracket 416, as will be described in more detail below.

The rear surface of the backrest 418 may be provided with a pocket flap 434 in order to form a pocket on the back of the backrest 418. Preferably, the pocket flap 434 will be formed from a transparent material, such as clear plastic or vinyl, so that written materials may be seen and read through the pocket flap 434. As best seen in detail FIG. 28A, a card 436 with information, such as row and seat number may be inserted into the pocket 434 so that patrons know where to sit in case of assigned seating. In addition to, or in place of, the seat and row number, the card may be imprinted with advertising material or other information pertaining to the event being watched from the bleacher seat.

Many of the details of the bottom cushion 420 and backrest 418 may be similar to that described above relative the seat cushion 310. For example, gussets 328 may be used to connect the flexible straps 422 to the bottom cushion and backrest 418. Buckles 438 may be used to adjust the length of the flexible straps 422.

The details of the bracket 416 are best shown in FIGS. 30-34. The bracket 416 includes a front jaw 442 and a rear jaw 444. The front jaw 442 has a front portion that includes a pair for elongated front jaw members 446 bent to form J-shaped hooks 448 at their front ends. The rear ends of the front jaw members 446 are bent upwardly at tabs 450 which are fixed on to angle flange 452 that spans between the two front jaw members 446. The elements of the bracket 416 may be formed from steel or similar hard material that is bent to shape and treated with a corrosive preventative, such as paint. Other materials may be used such as stainless steel, fiberglass, vinyl, hard plastics, wood, and the like. In a preferred hardened steel version, the front jaw members 446 are affixed to the angle flange 452 by weldments (not shown).

The angle flange 452 includes an upwardly turned lip 454. A plurality of passageways 456 are provided through the lip 454, such that the passageways 456 are rearwardly disposed. The passageways 456 may be smooth bores, or may be threaded. It is preferred that at least three passageways 456 be provided such that a variety of laterally offset attachment points are provided for the rear jaw 444.

The rear jaw 444 has a unitary construction with a hook 458 formed at a lower portion. In the embodiment shown, the hook 458 is J-shaped, but could be L-shaped, or formed in other shapes for engaging the rear portion of the bleacher 412. The upper portion of the rear jaw 444 includes an aperture (not shown) through which an attachment member 460 may pass. The attachment member 460 may be threaded as a bolt or similar member. The threaded attachment member 460 may include a head 462 for receiving a tool such as a flat or phillips head screw driver, or an allen wrench. Alternatively, the head 462 could be formed to include tabs or flanges for hand tightening. According to one aspect of the present invention it is preferred that use of a tool is required to remove the attachment member once tightened in order to prevent easy removal of the seat cushion 414 by patrons. A threaded nut 466 may provided for threaded engagement with the attachment member 460, or a plurality of nuts 466 be welded or otherwise adhered to the front face of the lip 454 in alignment with each passageway.

The laterally offset passageways 456 are of particular importance because they provide for multiple attachment locations for the rear jaw 444. This can be important because the bleacher seat 412 may include attachment hardware 464 (see FIG. 34) or the like to fasten the bleacher seat 412 to the stadium. This attachment hardware 464 may obstruct or impede location of the rear jaw over some span of the angle flange 452. By including more than one attachment location in the form of the laterally spaced passageways 456, the rear jaw 444 may be attached an unobstructed location.

In use, the elongated members 446 of the front jaw 442 are threaded through the front and rear loops 430 and 432 on the bottom of the bottom cushion 420. This securely fastens the seat cushion 414 to the bracket 416. The front jaw 442 and seat cushion 414 are then attached to the bleacher seat 412 by hooking the front hooks 448 of the front jaw over the front portion of the bleacher seat 412 and setting the elongated members 446 and the bottom cushion 420 on the upper surface of the bleacher 412. The rear jaw 444 is this used to securely mount the front jaw 442 and seat cushion 414 to the bleacher 412 by hooking the lower hook 458 under the rear portion of the bleacher seat 412 and bringing the aperture in the rear jaw 444 into alignment with one of the passageways 456 in the upwardly turned lip 454 of the front jaw 442 and inserting the attachment member 460. The attachment member 460 should be secured in place, for example by rotating the threaded member 460 against a threaded female nut 466 until tight in order to draw the front 442 and rear 444 jaws tightly together. If the location of the rear jaw 444 at one or more of the passageways 456 is obstructed, for example by attachment hardware 464 (see FIG. 34) for the bleacher 412, a passageway 456 at an unobstructed location should be selected. The open portion 428 provided at the lower portion of the backrest 418 is advantage as it avoids interference between the attachment member 460 or nut 466 and the backrest 418.

The angle of recline for the backrest 418 relative to the bottom cushion 420 may be adjusted by adjusting the length of the flexible straps 422, if desired. This a user may customize the seat cushion 414 to suit their preferences.

An information card 436, with seat number information may be inserted into the pocket 434. This permits a user to determine their assigned seat, even if the seat cushion 414 covers the markings on the bleacher 412. Furthermore, the same seat cushion 414 may be removed and moved to a different location and the old card 436 may be replaced with a new card 436 in the pocket 434.

The upwardly extending lip 454 provides support against rearward movement of the bottom cushion 420 relative to the bleacher 412. This helps provided a solid comfortable seating arrangement.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

I claim:

1. A bracket for use in attaching a cushioned seat to a bleacher seat, the bracket comprising:

a first law member comprising:

an elongated member having a top side, a bottom side, a first end and a second end, the bottom side in contact with the top of a bleacher seat;

a front jaw connected to the first end of the elongated member and engaging the front portion of the bleacher seat, and a rear portion connected to the second end of the elongated member and extending upward from the top side of the elongated member;

a second jaw member comprising:

an elongated member having a top side, a bottom side, a first end and a second end, the bottom side in contact with the top of a bleacher seat;

a front jaw connected to the first end of the elongated member and engaging the front portion of the bleacher seat, and a rear portion connected to the second end of the elongated member and extending upward from the top side of the elongated member;

an angle flange having a bottom portion connected to an upwardly turned lip and a plurality of laterally offset passageways extending through the upwardly turned lip, the angle flange bottom portion attached to a portion of the elongated members of the first and second jaw members, and the angle flange upwardly turned lip attached to the rear portions of the first and second jaw members;

a rear jaw member having a lower portion and an upper portion, a rear jaw formed at the lower portion for engagement with a rear portion of the bleacher seat, and an aperture in the upper portion for alignment with any one of the laterally offset passageways; and an attachment member for binding the first and second jaw members and rear jaw member together upon insertion through the aperture and one of the laterally offset passageways aligned with the aperture.

2. The bracket according to claim 1, wherein the front jaw of the first and second jaw members comprise L-shaped hooks, and wherein the rear jaw comprises a J-shaped hook.

3. The bracket according to claim 2, wherein the angle flange spans between the first jaw member and the second jaw member.

4. The bracket according to claim 3, wherein the attachment member is a threaded male member.

5. A bracket for use in attaching a cushioned seat to a bleacher seat, the bracket comprising:

a front jaw member having a front hook for engagement with a front portion of a bleacher seat and an elongated jaw member extending from the front hook to an upward extending rear end a distance away from the front hook;

an angle flange including a bottom portion and a lip portion, the lip portion having a plurality of laterally offset passageways, the lip portion connected to the upward extending rear end and the bottom portion connected to a portion of the elongated jaw member connecting the angle flange to the front jaw member;

a rear jaw having a rear hook portion for engagement with a rear portion of the bleacher seat, the rear jaw including an aperture for alignment with any one of the laterally offset passageways; and an attachment member for removably attaching the front jaw member and the rear jaw together upon insertion of the attachment member through the aperture and one of the laterally offset passageways aligned with the aperture.

6. The bracket according to claim 5, wherein the front hook and rear hook comprise a J-shaped hook.

7. The bracket according to claim 5, wherein the front hook and rear hook comprise an L-shaped hook.

8. The bracket according to claim 5, wherein the front hook comprises an L-shaped hook and the rear hook comprises a J-shaped hook.

9. The bracket according to claim 5, further comprising:

a second front jaw member having a second front hook for engagement with a front portion of a bleacher seat and a second elongated jaw member extending from the second front hook to a second upward extending rear end a distance away from the front hook, the second upward extending rear end connected to the lip portion of the angle flange, and a portion of the second elongated jaw member connected to the bottom portion of the angle flange, connecting the angle flange to the second front jaw member; and the bottom portion of the angle flange having a first end and a second end, the front jaw member connected toward the first end of the angle flange and the second front jaw member connected toward the second end of the angle flange.

10. The bracket according to claim 9, wherein the front jaw member and second front jaw member are connected to the angle flange by weld.

11. A bracket for use in attaching a cushioned seat to a portion of a bleacher, the bracket comprising:

an angular member comprising:

a first end, a second end, a first portion disposed of between the first and second ends and arranged substantially parallel to the bleacher, and a second portion attached to the first portion and extending upward from the first portion and away from the bleacher seat, the second portion having a plurality of laterally offset passageways therethrough;

a first jaw member comprising:

a first elongated member having a first end and a second end, a first front jaw connected to the first end of the first elongated member, a first upward extending end connected to the second end of the first elongated member, the first jaw member connected to the first end of the angular member by the first upward extending end connected to the second portion of the angular member, and a portion of the first elongated member connected to the first portion of the angular member;

a second jaw member comprising:

a second elongated member having a first end and a second end, a second front jaw connected to the first end of the second elongated member, a second upward extending end connected to the second end of the second elongated member, the second jaw member connected to the second end of the angular member by the second upward extending end connected to the second portion of the angular member, and a portion of the second elongated member connected to the first portion of the angular member;

a third jaw member comprising:

an upper portion having an aperture, and a lower portion having a third jaw;

an attachment member for removably connecting the third jaw member with the second portion of the angular member upon insertion of the attachment member through the aperture and one of the laterally offset passageways of the angular member.

12. The bracket according to claim 11, wherein the first and second jaw members include a bottom portion, and the bracket connects to the bleacher by the first and second front jaws engaging a front portion of the bleacher, the third jaw engaging a rear portion of the bleacher, and the bottom portions of the first and second jaw members are positioned on an upwardly facing surface of the bleacher.

13. The bracket according to claim 12, further comprising:

the first jaw member further includes a top portion;

the second jaw member further includes a top portion;

a cushioned seat including a bottom cushion and a backrest flexibly connected with the bottom cushion by at least one fabric hinge, the bottom cushion including a bottom surface for resting on the top portions of the first and second jaw members and the upwardly facing surface of the bleacher; and an attachment element on the bottom cushion for attaching the cushioned seat to the bracket.

14. The bracket according to claim 11, wherein the attachment member has a threaded portion.

15. The bracket according to claim 14, wherein the laterally offset passageways are threaded to receive the threaded portion of the attachment member.

16. The bracket according to claim 14, wherein the attachment member includes a threaded nut adapted to receive the threaded portion.

17. The bracket according to claim 11, wherein the angular member is positioned perpendicular to the first and second jaw members.

18. The bracket according to claim 11, wherein the first and second front jaws include an L-shaped hook.

19. The bracket according to claim 18, wherein the third jaw includes a J-shaped hook.

20. The bracket according to claim 11, wherein the second portion of the angular member extends a first distance away from the first portion, and the first and second upward extending ends of the first and second jaw members extend a second distance not to exceed the first distance.

* * * * *